US005890250A

United States Patent [19]

Lange et al.

[11] Patent Number: 5,890,250

[45] Date of Patent: Apr. 6, 1999

[54] ROBOTIC WASHING APPARATUS

[75] Inventors: Michael R. Lange, Minnetonka, Minn.; Jeff Kerr, Redwood City, Calif.

[73] Assignee: Sky Robitics, Inc., St. Paul, Minn.

[21] Appl. No.: 790,464

[22] Filed: Jan. 29, 1997

Related U.S. Application Data

[60] Provisional application No. 60/011,079 Feb. 2, 1996.

[51] Int. Cl.[6] ..... A47L 1/02

[52] U.S. Cl. ..... 15/50.3; 15/103; 15/302

[58] Field of Search ..... 15/50.1, 50.3, 15/103, 302, 319, 320; 134/172

[56] References Cited

U.S. PATENT DOCUMENTS

| | | | |
|---|---|---|---|
| 1,592,882 | 7/1926 | Artas . | |
| 2,098,262 | 11/1937 | Temple . | |
| 2,312,189 | 2/1943 | Petley . | |
| 2,718,656 | 9/1955 | Kirk . | |
| 3,056,153 | 10/1962 | Laughter, Sr. . | |
| 3,298,052 | 1/1967 | Wolfe . | |
| 3,454,976 | 7/1969 | Kijinski . | |
| 3,497,902 | 3/1970 | Hartigan . | |
| 3,646,630 | 3/1972 | Russell . | |
| 3,750,686 | 8/1973 | Cook . | |
| 3,775,804 | 12/1973 | Hoener, Jr. . | |
| 3,803,656 | 4/1974 | Fannon | 15/302 |
| 3,863,393 | 2/1975 | Goff . | |
| 3,915,738 | 10/1975 | Willard, Sr. . | |
| 3,984,944 | 10/1976 | Maasberg et al. . | |
| 3,999,242 | 12/1976 | Maruyama et al. . | |
| 4,025,984 | 5/1977 | Hoener | 15/302 |
| 4,136,419 | 1/1979 | Hetman et al. . | |
| 4,198,724 | 4/1980 | Fisher et al. | 15/103 |
| 4,664,212 | 5/1987 | Nagatsuka et al. . | |
| 4,797,969 | 1/1989 | Caduff . | |
| 4,800,607 | 1/1989 | Fukutomi . | |
| 4,809,384 | 3/1989 | Yokota et al. . | |
| 4,971,591 | 11/1990 | Raviv et al. . | |
| 4,997,052 | 3/1991 | Urakami . | |
| 5,014,803 | 5/1991 | Urakami . | |
| 5,249,326 | 10/1993 | Jefferies et al. . | |
| 5,465,446 | 11/1995 | Chang | 15/103 |
| 5,707,455 | 1/1998 | Tomita | 15/103 |

FOREIGN PATENT DOCUMENTS

| | | |
|---|---|---|
| 2145927 | 9/1983 | United Kingdom . |

OTHER PUBLICATIONS

Videotape marked "Vass Over Reno W/C Trade Show".

Japanese product brochure, M Engineering, undated.

Product brochure, "HydroCat," Flow International Corporation, 1997.

Product brochure, "WallWalker™," Pentek Decontamination Products Division, 1996.

*Primary Examiner*—Terrence Till

*Attorney, Agent, or Firm*—Dorsey & Whitney LLP

[57] ABSTRACT

The present invention relates to a robotic apparatus for applying fluids to the exterior surfaces of vertical, nearly vertical, or sloped surfaces with minimum human supervision. The robotic apparatus is designed to apply fluids to surfaces which may include obstacles such as window frames or gaps created by window seams, which the present invention is designed to traverse. The robotic apparatus includes a housing, a drive assembly, a sliding vacuum assembly, a fluid spray assembly, and sensor and control systems. The drive assembly includes drive chains, cables, ropes or the like that are connected at one end to a carriage positioned on the top of the structure and to a stabilizing member or members at the other end.

19 Claims, 23 Drawing Sheets

ROBOTIC WASHING APPARATUS

This application is based on U.S. Provisional Application No. 60/011,079 filed Feb. 2, 1996, and claims, under 35 U.S.C. 119(e), the benefit of U.S. Provisional Application No. 60/011,079.

SUMMARY OF THE INVENTION

The present invention relates to a robotic washing apparatus. The robotic washing apparatus of the present invention washes vertical, nearly vertical, or sloped surfaces with minimum human supervision. The robotic washing apparatus is designed to clean surfaces which may include obstacles such as window frames or gaps created by window seams, which the present invention is designed to traverse.

More specifically, the robotic washing apparatus of the present invention includes a housing, a drive assembly, a sliding vacuum assembly, a cleaning assembly, and sensor and control systems.

The drive assembly includes drive chains, cables, ropes or the like, a drive motor, and a sprocket assembly. The drive chains, cables, ropes or the like, are connected at one end to a carriage positioned on the top of the building or surface being cleaned and to a weight at the other end, or each chain is attached to a weight or other stabilizing member.

The sliding vacuum assembly includes multiple vacuum cups, pneumatic cylinders, and a series of air vacuum generators. Compressed air for operating the air vacuum generators is provided via an air hose suspended from the vicinity of the carriage or a vacuum pump can be an integral component of the robotic washing apparatus. At least some of the vacuum cups are attached to cylinders that are slidably extendable.

The cleaning assembly includes multiple scrubbing brushes and at least two spray assemblies. The scrubbing brushes are rotatably attached to the housing so as to provide cleaning coverage that spans substantially the width of the housing. One spray assembly provides a cleaning liquid to the surface to be cleaned and the another spray assembly provides at least one type of rinse liquid to displace the cleaning liquid.

The sensor and control systems include (1) a control console for manually providing various signals to the robotic washing apparatus and for activating electrical, pneumatic and fluid feeds; (2) a sensor and control for detecting the robotic washing apparatus' position relative to its position on the drive chain, cable, rope or the like and stopping and changing the direction of the movement of the robotic washing apparatus; (3) an obstacle/gap sensor for detecting projections or gaps in the path of the vacuum cups; (4) a vacuum sensor for detecting whether the vacuum cups are in positive contact with the surface being cleaned; and (5) an incremental optical encoder for determining the position of the robotic washer relative to any projections or gaps sensed by the obstacle/gap sensor.

In operation, the robotic washing apparatus of the present invention is suspended along the side of a building from a carriage which is rollably positioned on the top of the building adjacent its outside edge. While the robotic washing apparatus hangs from the carriage, the vacuum cups of the robotic washing apparatus are preferably approximately 2 to 8 inches from the building surface. With the apparatus of the present invention positioned at a top of the building and to the far left or right side of one wall, the operator activates the robotic washing apparatus' cleaning cycle.

When the robotic washing apparatus is activated, it first adheres itself to the building surface by extending its extendable vacuum cups until contact is made with the building surface, developing a vacuum, and retracting the extendable vacuum cups, thereby, bringing its scrubbing brushes in contact with the building surface. Next, the drive motor and scrubbing brushes are activated and the liquids sprayed on the brushes and building surface. The drive motor powers the robotic washing apparatus down the building at a predetermined rate of speed. The vacuum cups slide along and maintain contact with the building surface so that the scrubbing brushes are sufficiently compressed against the surface. When the scrubbing brushes are sufficiently compressed against the surface they are able to effectively clean the building surface.

When the obstacle/gap sensor encounters an obstacle or gap, vacuum to some or all of the vacuum cups is terminated in a manner coordinated with the drive motor causing and allowing the robotic washing apparatus to "step over" the frame. The building surface is reacquired by the extendable vacuum cups after the robotic washing apparatus has traversed the obstacle or gap. When the robotic washing apparatus senses that it is at the bottom of the building, the brushes stop, and the vacuum to all the cups is terminated.

The carriage is then rolled over to the next uncleaned section of the building, and the apparatus is driven to the top of the building. As it is driven to the top of the building, the vacuum cups are not attached to the building surface. When the robotic washing apparatus senses it has reached the top of the building, the apparatus automatically stops, and the entire process is repeated.

It is an object of the present invention to provide a robotic washing apparatus that automatically traverses obstacles in its path while cleaning a surface.

It is a similar object of the present invention to provide a robotic washing apparatus that is adaptable to many types of surfaces.

It is another object of the present invention to provide a robotic washing apparatus that maintains positive contact with the surface it is cleaning by means of a vacuum attachment.

It is still another object of the present invention to provide a robotic washing apparatus that can operate in various weather conditions.

It is yet another object of the present invention to provide a robotic washing apparatus that recognizes the beginning and end of the surface to be cleaned.

It is a further object of the present invention to provide a robotic washing apparatus that can reacquire the cleaning surface automatically and continue its cleaning cycle if it loses its connection.

Other objects and advantages of the present invention will become more fully apparent and understood with reference to the following specification and to the appended drawings.

BRIEF DESCRIPTION OF THE DRAWINGS

FIG. 14*a* shows the suction cup assembly in its free travel position, FIG. 14*b* shows the suction cup assembly in its grabber position, and FIG. 14*c* shows the suction cup assembly in its slider position.

DETAILED DESCRIPTION OF THE INVENTION

Figure 1:
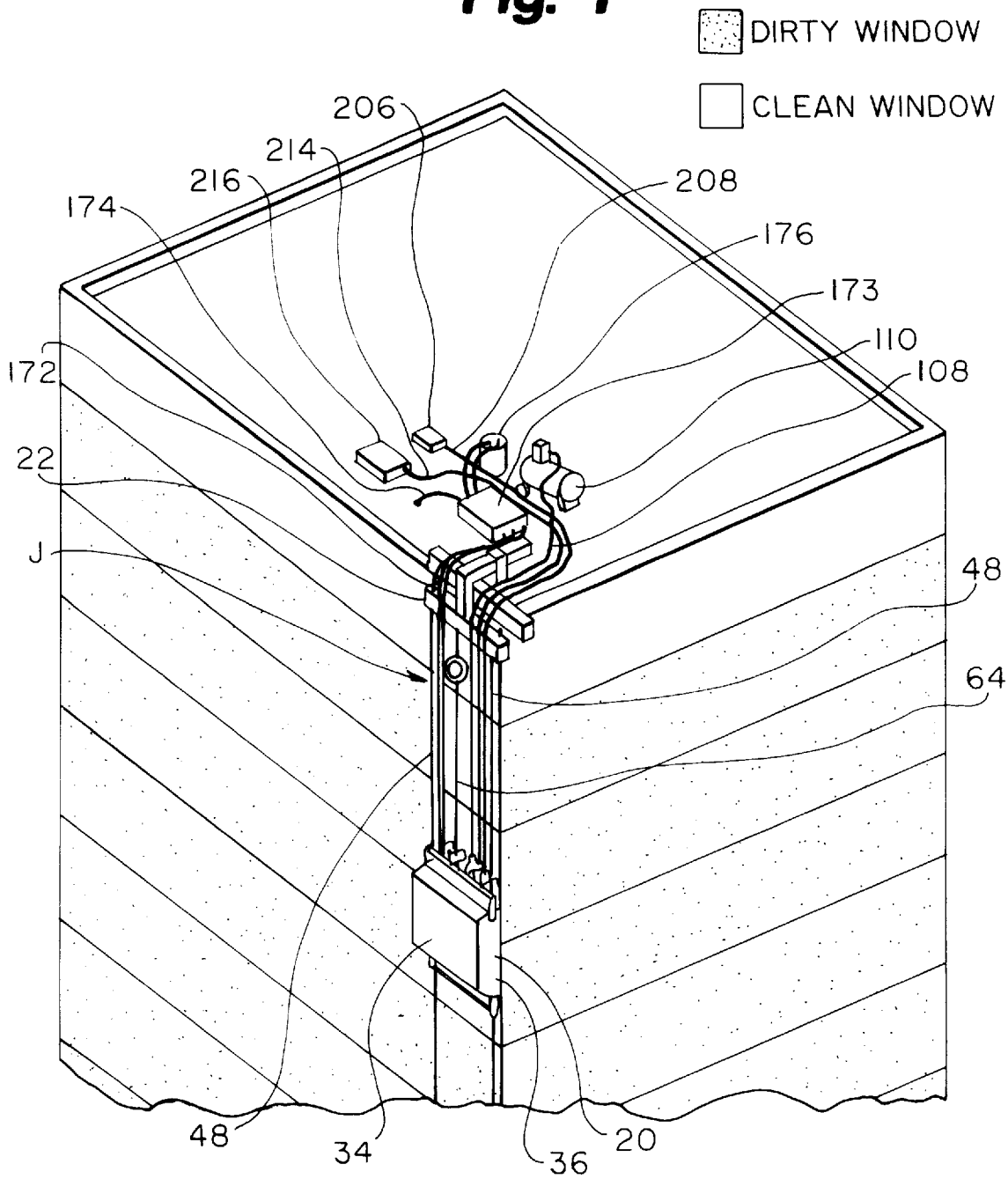
FIG. 1 is an isometric view of a robotic washing apparatus of the present invention attached to a carriage and cleaning the side of a building.

Reference is first made to FIG. 1 showing a robotic washing apparatus 20 of the present invention cleaning the side of a building. As seen in FIG. 1, the robotic washing apparatus 20 is suspended from a commercially available carriage 22 mounted to the top of the building to be cleaned. Parapet wall roller (WR1000) is a type of carriage commercially available which is sold by Fitch Enterprises of Council Bluffs, Iowa. The carriage is modified so that the distance between washing apparatus 20 and surface being cleaned can be adjusted. The carriage 22 is usually rollably positioned at an edge of the building so that once the robotic washing apparatus 20 cleans one vertical section of the building surface, the carriage 22 can be moved to the next vertical section of the building to be cleaned. As seen in FIG. 1, the robotic washing apparatus 20 cleans in a top to bottom direction.

Figure 2:
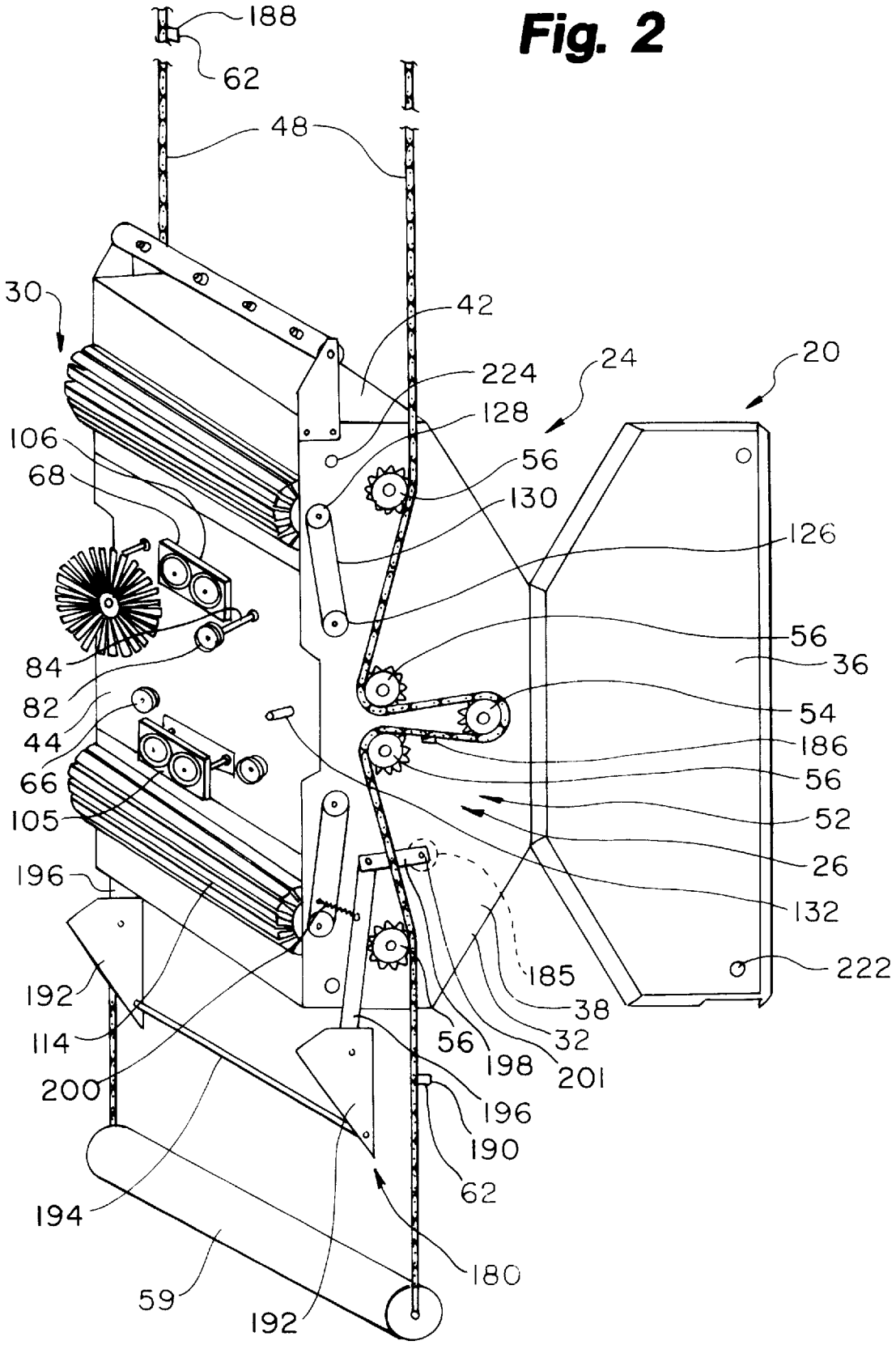
FIG. 2 is an isometric view of a robotic washing apparatus incorporating the improvements of the present invention with one brush removed and a side cover moved to its open position.
Figure 8:
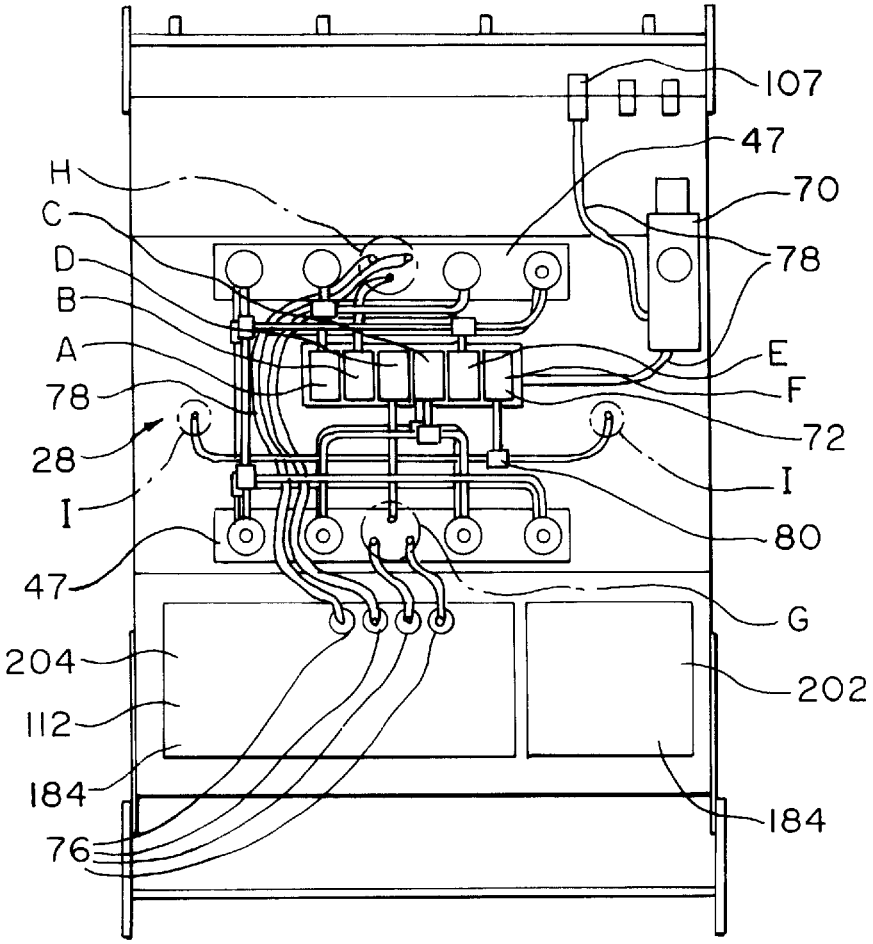
FIG. 8 is a partial top plan of the housing with the cover and many of the internal components removed showing the vacuum assembly components.
Figure 9A:
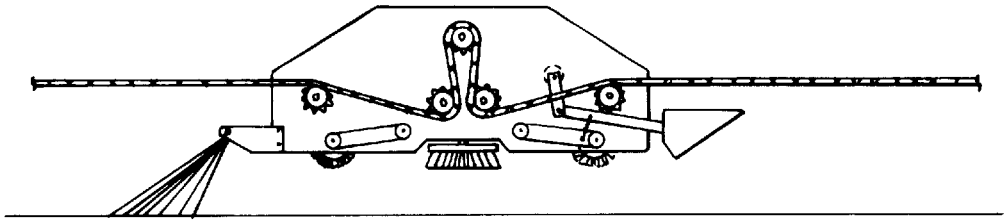
FIGS. 9*a–d* is a sequence depicting the robotic washing apparatus in side view with the side cover removed acquiring a window surface with its plunger cups.
Figure 9B:
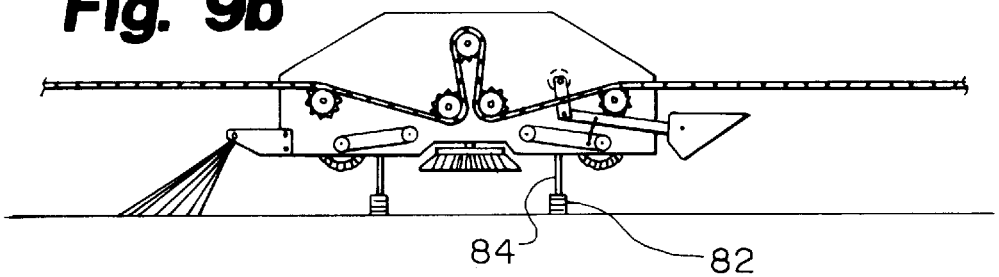
Figure 9C:
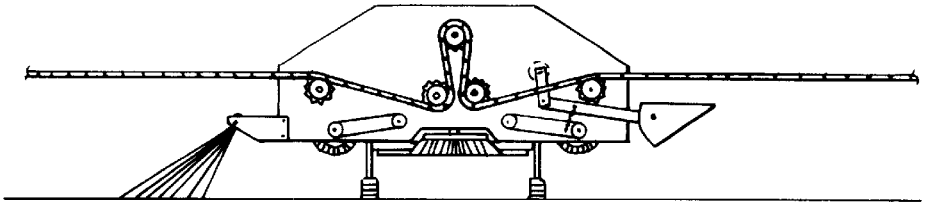
Figure 9D:
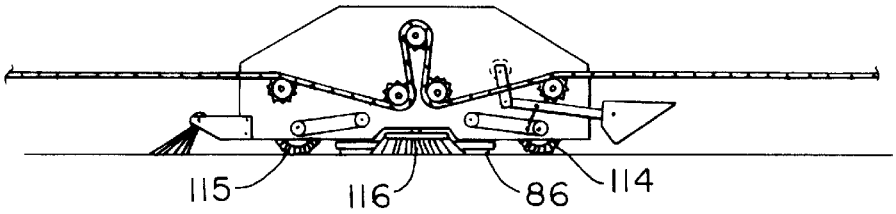

As shown in FIGS. 2 and 8, the robotic washing apparatus 20 of the present invention broadly includes a housing 24, a drive assembly 26, a vacuum assembly 28, a wheel assembly 29, a cleaning assembly 30, and sensing and control systems.

Figure 3:
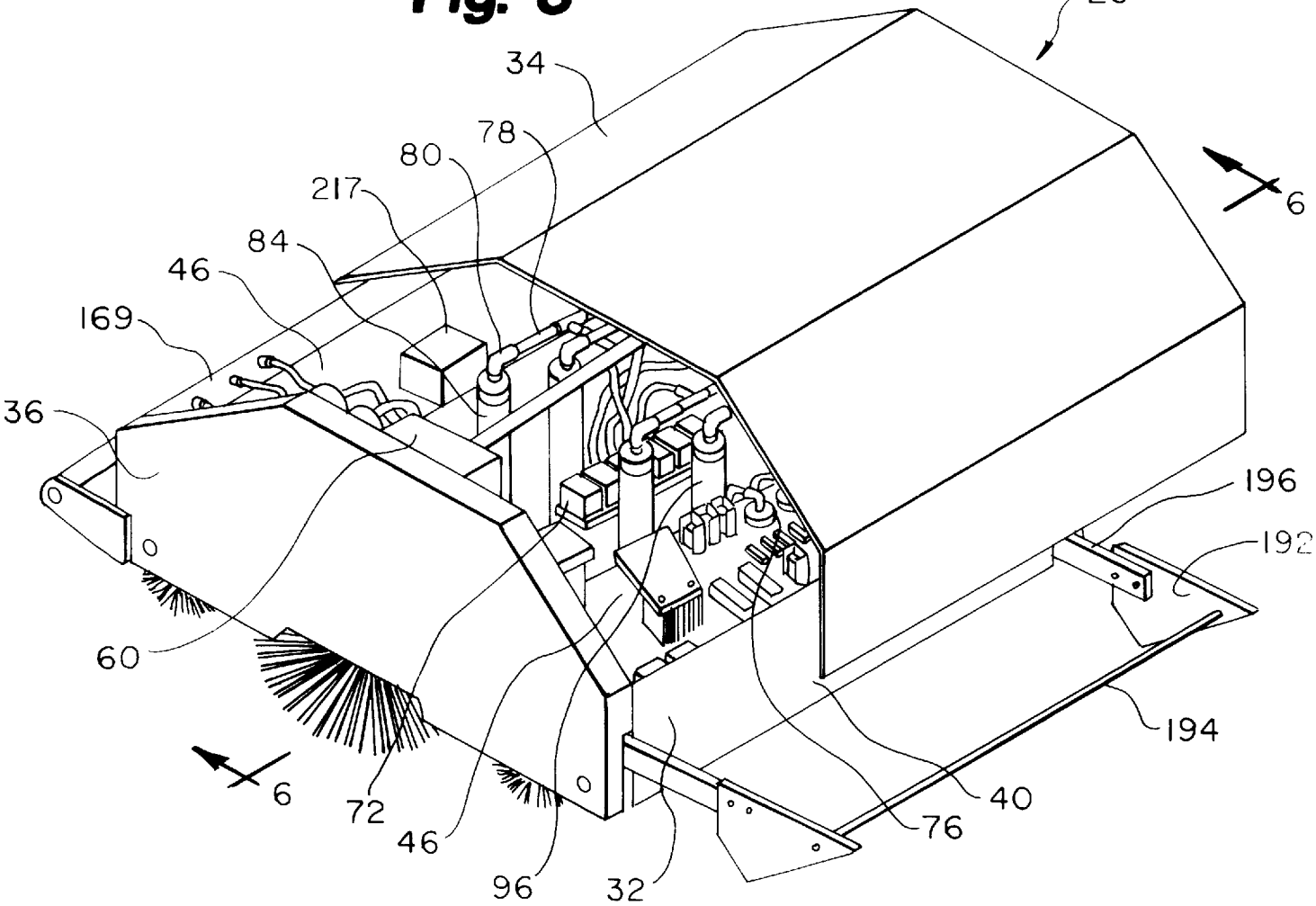
FIG. 3 is an isometric view of a robotic washing apparatus incorporating the improvements of the present invention with its top cover lifted above main frame of the housing.

With reference to FIGS. 2 and 3, the housing 24 includes a main frame 32, a detachable cover 34 and two side covers 36 that are hingedly attached to the main frame 32. The main frame 32 includes two side panel portions 38, a front plate portion 40, a rear plate portion 42, a floor plate portion 44, and two shelf plate portions 46. Two bulk heads 47 are mounted on the floor plate portion 44, as seen in FIG. 8.

Figure 7:
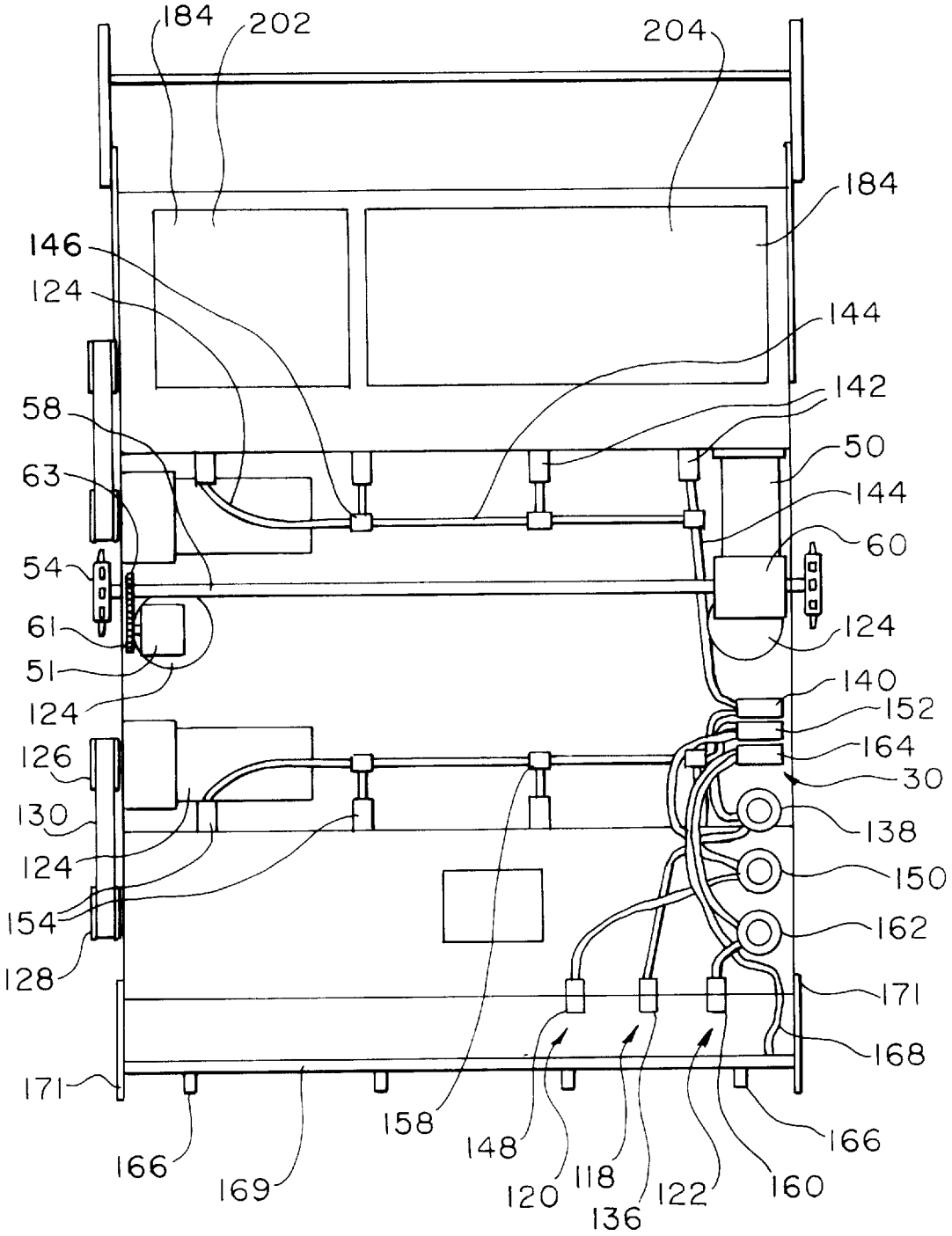
FIG. 7 is a partial top plan of the housing with the cover and many of the internal components removed showing the cleaning assembly components.

The drive assembly 26 includes two drive chains, cables, belts, ropes or the like 48, a drive motor 50, an encoder 51 and sprocket assembly 52. As best seen in FIG. 2, the sprocket assembly 52 includes a drive sprocket 54 and four idler sprockets 56 on each side of the robotic washing apparatus 20. The two drive sprockets 54 are mounted on a common drive shaft 58, as seen in FIG. 7. Also, the incremental encoder 51 is mounted on the drive shaft 58. Feedback from the encoder 51 is used to determine the position of the robotic washing apparatus 20 relative to the window frames it detects while washing the building. The encoder 51 includes a gear 61 that is connected to a gear 63 on the drive shaft 58.

The drive shaft 58 includes a drive shaft sprocket that is connected to a worm gear which is driven by the drive motor 50. The worm gear and drive shaft sprocket are enclosed within a gear box 60. In the preferred embodiment, the drive motor is a 24 volt DC brush motor. The drive motor 50 is driven with a variable duty cycle "pulse-width-modulated" (PWM) signal for varying the speed of the drive motor 50. In the preferred embodiment there are only two speeds used (low-speed for cleaning, high-speed for returning to the top), but other additional motor speeds can be used. The worm gear reduction has a 40:1 ratio and because it is non-backdrivable, any disabling of the power to the motor will cause the robotic washing apparatus 20 to stop even when hanging vertically from a building. The drive sprockets 54 and the drive shaft sprocket are positively keyed to the shaft 58. A relay is used to switch the direction of the drive motor 50 for ascending or descending the building.

In the preferred embodiment, plastic or stainless steel roller chains 48 are threaded through the series of idler sprockets 56 and the drive sprockets 54 as seen in FIG. 2. The idler sprockets 56 are arranged so as to maintain chain engagement with the drive sprockets 54 over a wide variance of positions by the robotic washing apparatus 20 and so that it hangs essentially parallel to the surface being cleaned when suspended by a carriage 22 from the top of a building. An extended reflective connecting link 62 is incorporated into one drive chain 48 adjacent the top edge of the surface to be cleaned and into the other chain 48 adjacent the bottom edge of the surface to be cleaned. The ends of the chains 48 adjacent the bottom edge of the surface to be cleaned are attached to a cylindrical weight 59. In the preferred embodiment, the length of the weight 59 is essentially the same as the width of the robotic washing apparatus 20 and weighs ten to twenty pounds depending on the height of the building being cleaned. As a backup to the non-backdrivable gearing 60, a safety tether 64 is suspended from the carriage 22 and attached to the robotic washing apparatus 20 in case the chains 48 fail, as shown in FIG. 1.

Figure 5:
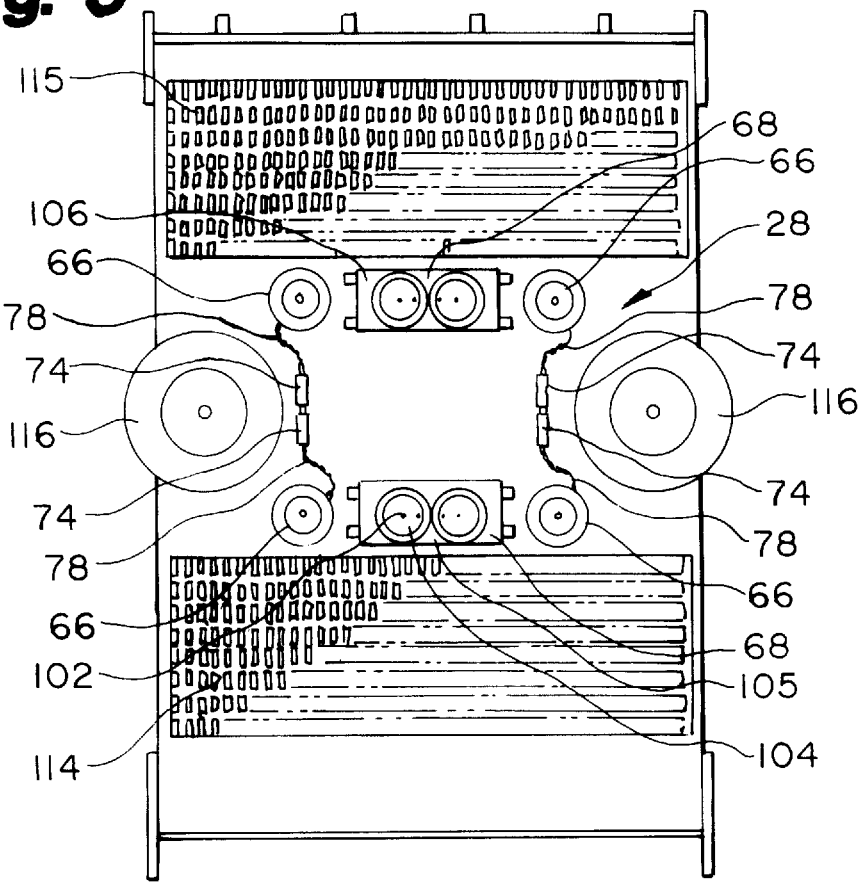
FIG. 5 is a bottom plan view of a robotic washing apparatus incorporating the improvements of the present invention.
Figure 6:
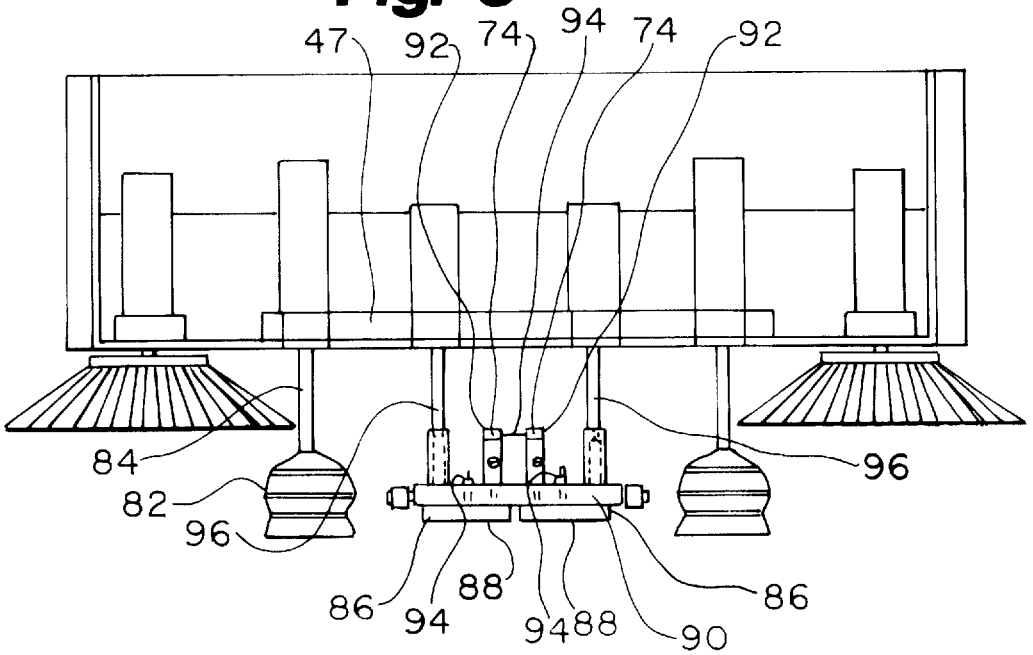
FIG. 6 is a sectional view, as viewed along the line 6—6 of FIG. 3, showing portions of the slider cup assembly, the plunger cup assembly and the brush assembly that are partially enclosed in the housing of the present invention.

As seen in FIGS. 5, 6, and 8, the vacuum assembly 28 includes four extendable grabber vacuum cup assemblies 66, two slider vacuum cups assemblies 68, an air pressure regulator 70, a series of vacuum solenoids 72, eight air vacuum venturi generators 74, four vacuum sensors 76 and various air lines 78 and air line fittings 80. In the preferred embodiment, the air pressure regulator 70 includes a water separator. As seen in FIGS. 2 and 6, each extendable grabber vacuum assembly 66 includes a grabber vacuum cup 82 and an extendable long-throw pneumatic grabber cylinder 84. The vacuum cups 82 are ordinary bellows vacuum cups. The grabber cylinders 84 are mounted to one of the housing bulkheads 47. Each grabber cylinder 84 is connected to a venturi generator 74 by an air line 78.

As shown in FIG. 6, each slider vacuum cups assembly 68 includes two slider vacuum cups 86 faced with a low-friction ring 88 made of Mylar®, Teflon®, plastic or the like, a slider cups platform 90, two air vacuum venturi generators 92, four ⅛ inch tubing barb fittings 94, and two slider cylinders 96. The slider cups platform 90 includes four roller retainer bolts 98, each bolt 98 retaining a roller 100. The slider cups platform 90 further includes four apertures: two vacuum sense apertures 102 and two vacuum port apertures 104. The slider cylinders 96 are mounted to the housing bulkheads 47. The slider vacuum cups assemblies 68 include a leading slider assembly 105 and a trailing slider assembly 106. The slider vacuum cups assembly 68 nearest the front plate 40 of the housing 24 is the leading slider assembly 105. The slider vacuum cups assembly 68 nearest the rear plate 42 is the trailing slider assembly 106. The leading slider assembly 105 and trailing slider assembly 106 are separated by a distance equal to the largest horizontal window frame expected to be encountered.

As seen in FIG. 8, in the preferred embodiment, the solenoids designated by Letters A and B control the vacuum for the grabber vacuum cups, the solenoids designated by Letters C and D controls the leading slider assembly 105 vacuum and cylinder movement, respectively, and the solenoids designated by Letters E and F controls the trailing slider assembly 106 vacuum and cylinder movement, respectively. The air lines designated in Area G are attached to the bulkhead 47. One line supplies air to the venturi generators 74 and the other two return air to the sensors 76. The air lines designated in Area H are attached to the bulkhead 47. One line supplies air to the venturi generators 74 and the other two return air to the sensors 76. The air lines designated in Areas I pass though the floor plate portion 44 of the housing 24 and supplies air to the venturi generators 74.

The air pressure regulator 70 is connected on one side of the housing 24 to the component plate 46. A quick disconnect air fitting 107 passes through the rear plate 42 adjacent the air pressure regulator 70 and an air line 78 connects the air pressure regulator 70 to the quick disconnect air fitting 106. As seen in FIG. 1, an external supply air line 108 is connected to the quick disconnect air fitting 106 and to a compressed air tank 110 on the roof of the structure being cleaned.

Another air line 78 connects the air pressure regulator 70 to the series of vacuum solenoids 72. Still additional air lines 78 connect the solenoids 72 to the grabber cylinders 84 and slider cylinders 96. Air lines 78 from the grabber vacuum cup assemblies 66 and slider cup assemblies 68 are connected to the vacuum sensors 76. The vacuum sensors are part of a peripheral interface board 112 attached to the component plate 46.

FIGS. 14*a–c* and 15 show a combination grabber/slider vacuum cup assembly 310 that can be used in an alternative embodiment of the present invention. The grabber/slider vacuum cup assembly 310 includes a base 312, two suction cups 314, an pneumatic cylinder 316, two air shafts 318, a shaft stabilizer 320 having two shaft collars 322 and a stabilizer bar 324, and vacuum check valve 326. The vacuum cups 314 each include a rigid circular disc 328 fitted with a deformable annular suction pad 330. In the preferred embodiment the suction pad 330 is made of foam rubber, but any suitable material may be used. As seen by comparing FIGS. 8 and 16, by incorporating the combination grabber/slider vacuum assembly 310 the number of certain components is reduced, such as vacuum sensors 76.

Figure 16:
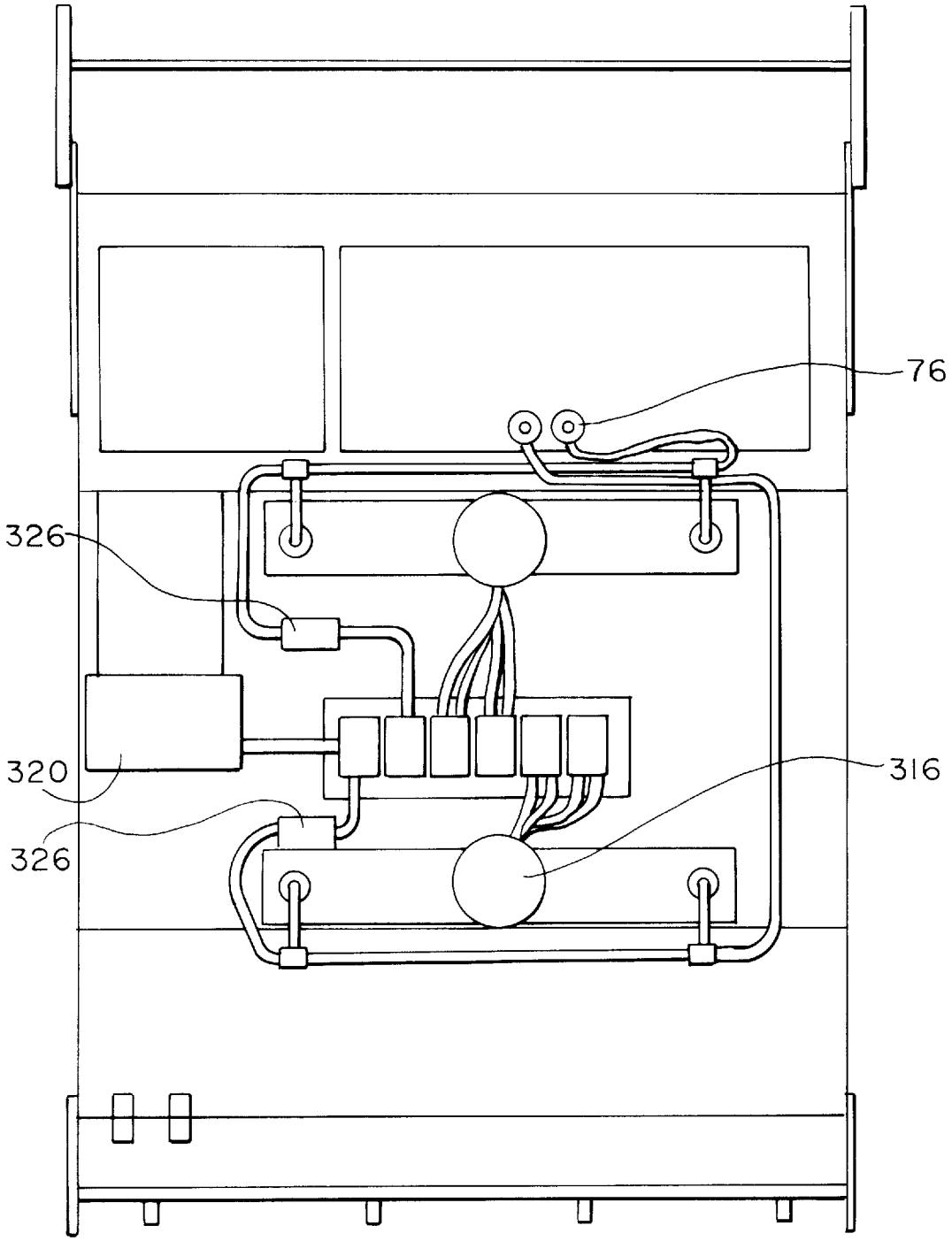
FIG. 16 is a partial top plan of the housing with the cover and many of the internal components removed showing the vacuum assembly components used when the combined slider and plunger cups assembly is used and when vacuum pumps are used rather than providing the apparatus with compressed air.

FIG. 16 also shows an alternative embodiment of the present invention where a vacuum pump 320 is mounted on the main frame 32. If a vacuum pump 320 is used, the compressed air source, such as an air tank 110, the air pressure regulator 70 and venturi generators 74 can be eliminated.

Referring to FIGS. 2 and 5, in the preferred embodiment the cleaning assembly 28 includes two rotating cylindrical brushes 114, 115, respectively, two rotating edge scrubbing brushes 116, a brush drive assembly and three independent liquid spray systems: a soapy water system 118, a rinse water system 120 and a deionized water system 122. As seen in FIG. 7, the brush drive assembly includes four brush drive motors 124. These motors are 24 volt DC motors that are commercially available. One motor 124 drives each cylindrical brush 114, 115 and each edge scrubbing brush 116. As seen in FIG. 2 and 7, the brush drive assembly further includes two cylindrical brush drive pulleys 126, two cylindrical brush tracking drive pulleys 128 and two drive belts 130 on one side of the robotic washing apparatus 20. The motors 124 driving the edge scrubbing brushes 116 are connected by drive spindles 132.

As seen in FIG. 7, the soapy water system 118 includes a quick disconnect ¼ inch fitting 136, a pressure regulator 138, a 24 volt DC water solenoid 140, a set of four spray nozzles 142 and various liquid lines 144 and liquid line fittings 146. The rinse water system 120 includes a quick disconnect ¼ inch fitting 148, a pressure regulator 150, a 24 volt DC water solenoid 152, a set of four spray nozzles 154 and various liquid lines 156 and liquid line fittings 158. The deionized water system 122 includes a quick disconnect ¼ inch fitting 160, a pressure regulator 162, a 24 volt DC water solenoid 164, a set of four spray nozzles 166 and various liquid lines 168. The chemical composition of the deionized water used in the deionized water system 122 is an important consideration and a detailed disclosure concerning the use of deionized water in a window washing apparatus can be found in U.S. Pat. No. 5,249,326, which is incorporated herein by reference. It should also be understood that other chemical cleaners could be used in combination with, or as a substitute for, soapy water.

Figure 1A:
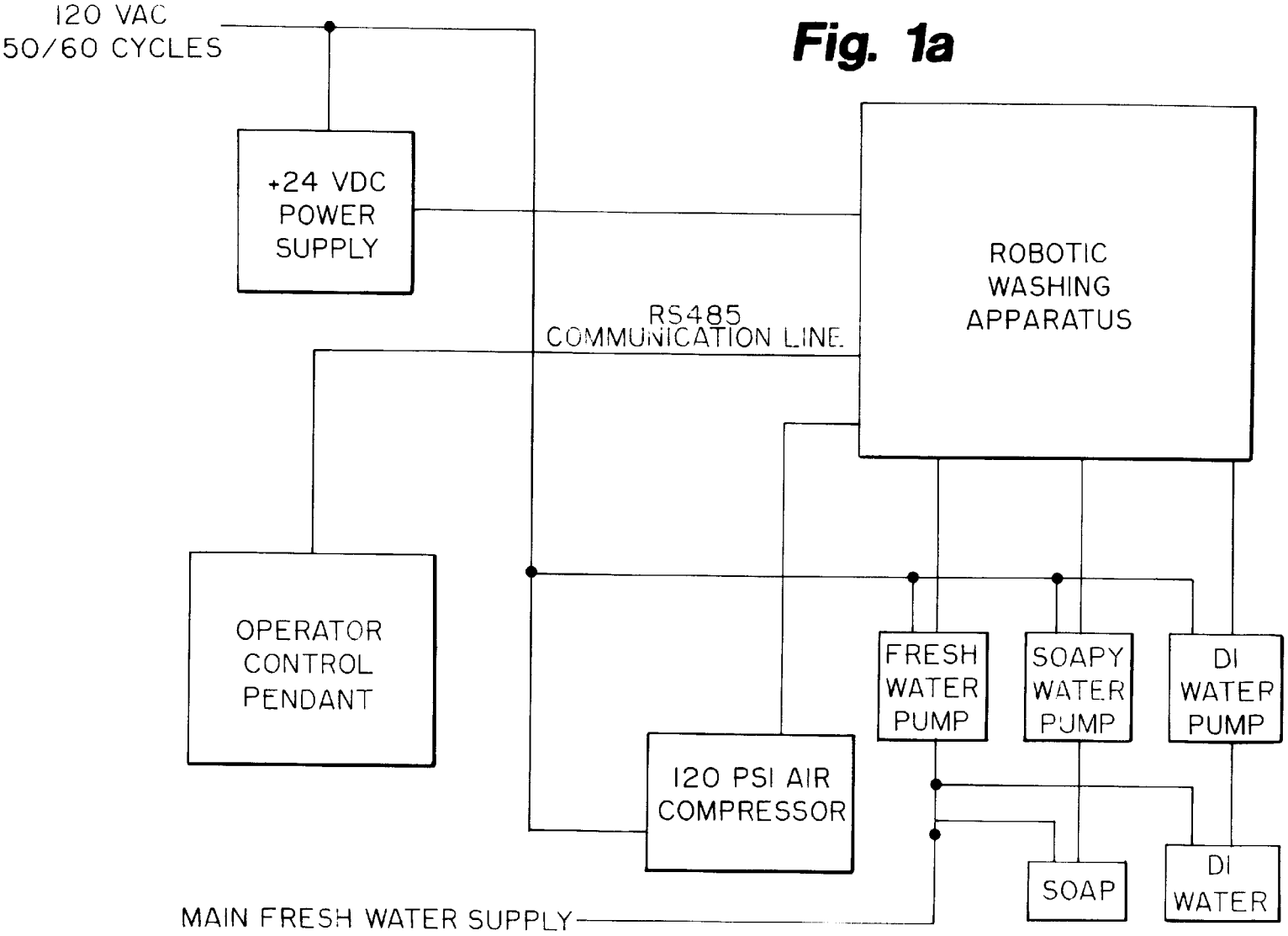
FIG. 1*a* is a block diagram illustrating components located on a building connected to the robotic washing apparatus of the present invention.

The spray nozzles 166 are mounted on a spray tube 169 which is connected to the main frame 32 by two brackets 171. The water for the three spray systems 118, 120 and 122 is provided from the top or bottom of the building via three separate ¼ inch water lines 172. As depicted in FIGS. 1 and 1*a*, the lines 172 that connect to quick disconnect fittings 136 and 148 are connected to a fluid pump box 173 containing pressure pumps for the soapy water system 118, the rinse water system 120 and the deionized water system 122. A water line 174 from the building being cleaned is connected to the pump box 173 and provides water for the soapy water system 118 and the rinse water system 120. Soap is injected into the line 172 connected to disconnect fitting 136. The line 172 that connects to the quick disconnect fitting 160 is connected to a tank 176 on the building that containing deionized water.

As seen in FIGS. 2–7, the sensing and control systems include an end of chain sensor assembly, a window frame sense assembly 180, the encoder 51 and an onboard computer 184. The end of chain sensor assembly includes two photo reflective sensors 186 and the two reflective connecting links 62 attached to the drive chain 48. In the preferred embodiment, one photo reflective sensor 186 is mounted on each side of the robotic washing apparatus 20, as seen in FIG. 2, and a one reflective connecting link 62 is attached to each drive chain 48. One reflective connecting link 62 is attached toward the carriage 22 end of one drive chain 48 as designated by Arrow J in FIG. 1, and is designated the top chain marker reflector 188 as shown in FIG. 2. As further shown in FIG. 2, the second reflective connecting link 62 is attached toward the weight 59 end of the second drive chain 48 and is designated the bottom chain marker reflector 190.

As best seen in FIG. 2, the window frame sense assembly 180 includes two window frame sensor feet 192, a window frame sensor spacing bar 194, two window frame sensor main levers 196, a window frame fulcrum lever 198 on one side of the robotic washing apparatus 20, two retainer springs 200, and a potentiometer 185 connected to the fulcrum lever 198 by a pin 201.

As depicted in FIGS. 7 and 8, the onboard computer 184 includes a 68HC11 microprocessor board 202, and a peripheral interface board 204 to control the various valves, motors and sensors. Both the microprocessor board 202 and the peripheral interface board 204 are mounted to the component plate 46. All of the timing and sequencing of operation is performed by the onboard computer 184.

Figure 13:
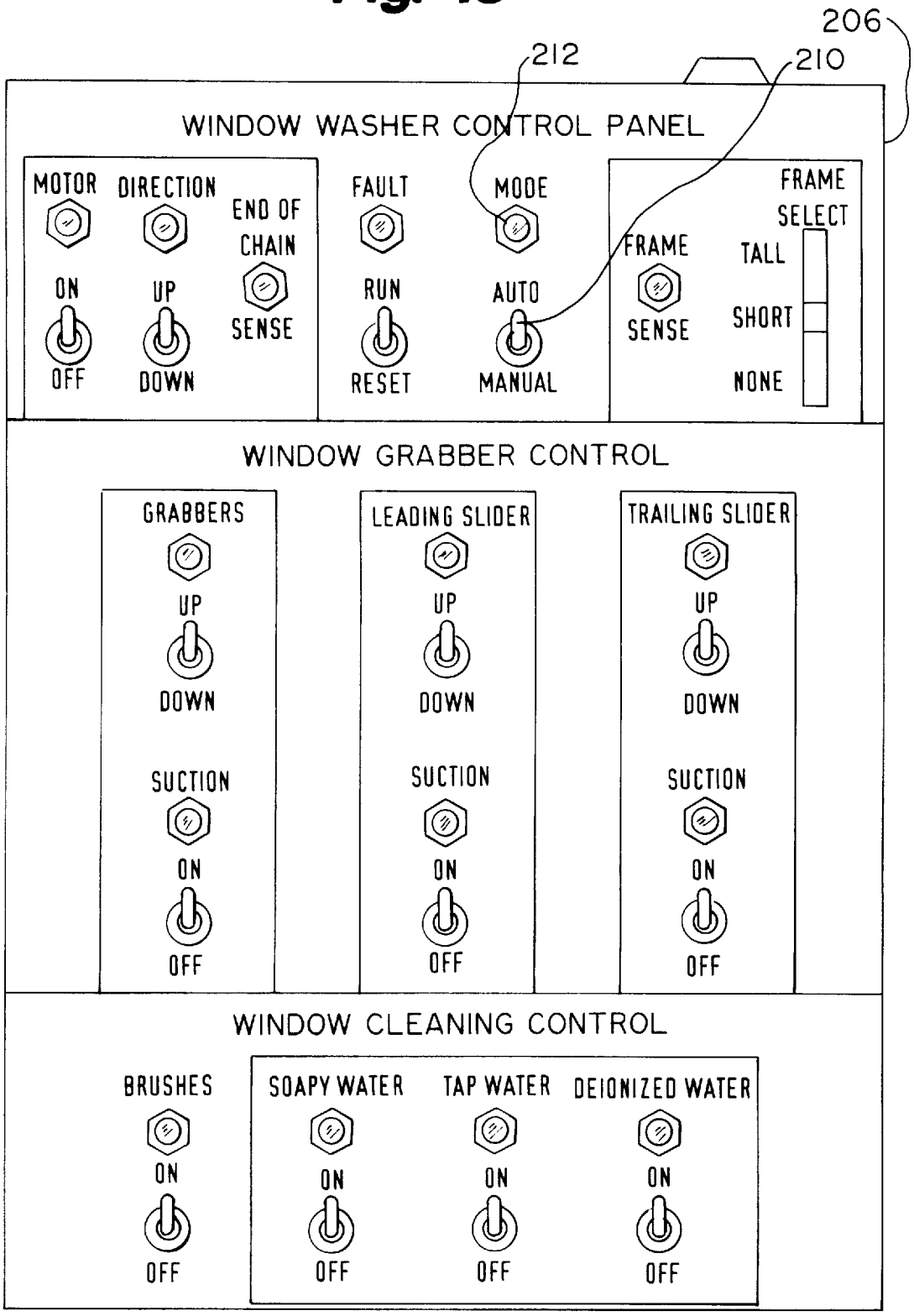
FIG. 13 is a top plan view of the operator control pendant.
Figure 18:
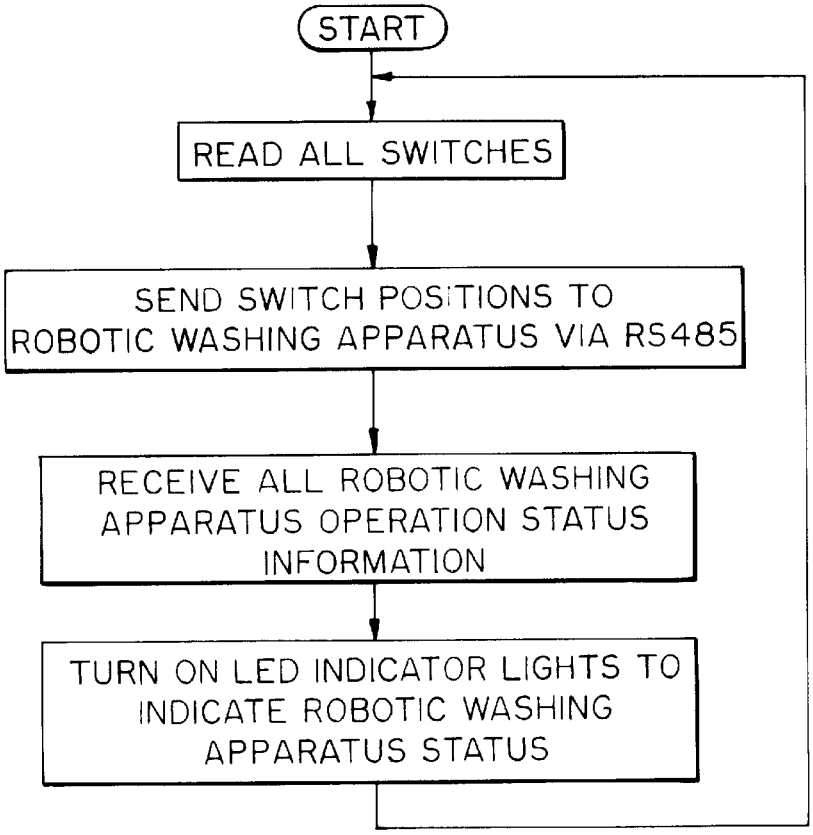
FIG. 18 is a flow chart of the steps performed via the software located in the operator control pendant.

In the preferred embodiment, the onboard computer 184 communicates with an operator control pendant 206, as shown in FIG. 13, via an RS485 serial communications link 208, as depicted in FIGS. 1 and 1*a*. Although the operator control pendant 206 is shown on top of the building in FIG. 1, it should be understood that the operator could operate the robotic washing apparatus 20 from any location within the reach of the communications link 208. The operator control pendant 206 consists of several control switches 210 and several indicator lights 212. As shown in FIG. 18, the software allows the processor inside the operator control pendant 206, another 68HC11 microprocessor, to simply read the state of the control switches 210 and send them down to the onboard computer 184, and then receive status information from the onboard computer 184 and display the information on the indicator lights 212. The operator control pendant 206 does no processing or evaluation of either the switch 210 states or the status information. The process of sending switch 210 states and receiving status information happens in a loop at a fixed rate of 10 times a second. It should be understood that the computer 184 could be housed in the pendant 206 rather than being onboard robotic washing apparatus 20.

The operator pendant has the following switches and corresponding status lights.

| Switch | Light |
|---|---|
| Reset/Run | Indicates if the washer is in a shutdown reset mode. |
| Up/Down | Indicates if motor is driving the washer up or down the building. It must be set to 'down' for automatic operation. In manual mode, the motor must be switched off before changing the state of this switch. |
| Auto/Manual | Indicates if the unit is proceeding with automatic operation. |
| Tall/Short/None | (No light) - switch used for specifying if building has seam, short or tall frames which can be stepped over or no obstacles or gaps. |

The following switches are only operation in manual mode, but the lights operate in both manual and automatic modes.

| | |
|---|---|
| Motor On/Off | Indicates if the drive motor is operating |
| Grabber Up/Down | Indicates if grabber cylinders are extended |
| Grabber Vacuum | Indicates if vacuum is applied to grabber vacuum cups |
| Leading Slider U/D | Indicates if leading sliding vacuum cylinders are extended |
| Leading Slider Vac | Indicates if leading sliding vacuum cups have vacuum |
| Trailing Slider U/D | Indicates if trailing sliding vacuum cylinders are extended |
| Trailing slider Vac | Indicates if trailing sliding vacuum cups have vacuum |
| Soapy On/Off | Indicates if cleaning solution spray is on |
| Tap On/Off | Indicates if ordinary rinse city tap water spray is on |
| D.I. On/Off | Indicates if de-ionized rinse water spray is on |
| Brushes On/Off | Indicates if the cylinder & edge scrubbing brushes are one |

Power for the electronics is provided from the top of the building via a 24 volt DC power cable 214 connected to a transformer 216 which is connected to the building's electrical system, as seen in FIG. 1. However, it should be understood that the electronics could be provided from the bottom of the building or in any other suitable location. The electrical system of the robotic washing apparatus 20 has a motor over current circuit. This circuit measures the current in the drive motor 50. If the robotic washing apparatus 20 becomes jammed or if it stalls because it has run past one of the chain marker reflectors 188, 190, the motor current will increase, triggering the shutdown of the drive motor 50. The electrical system of the robotic washing apparatus 20 also includes a noise reducer 217 that acts as a surge protector by restricting current spikes.

Figure 17:
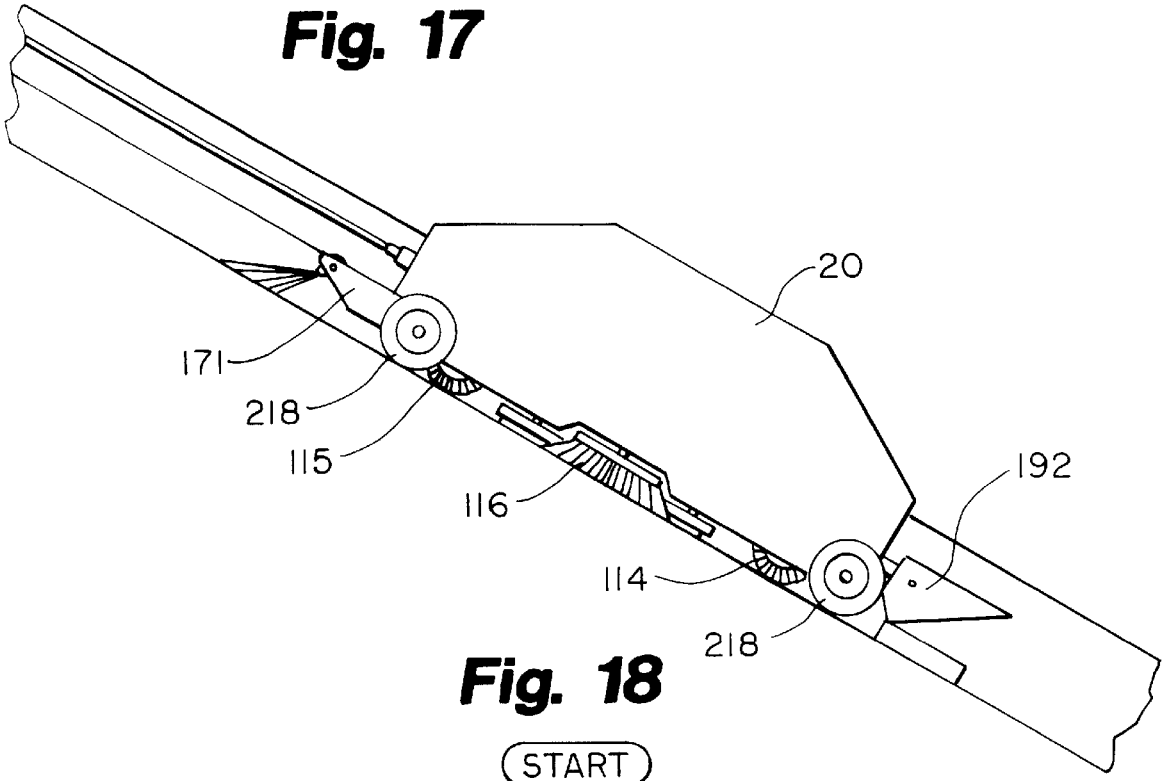
FIG. 17 is a side view of a robotic washing apparatus incorporating the improvements of the present invention with wheels mounted on the housing and cleaning a sloped surface.

As seen in FIG. 17, the wheel assembly 29 includes four wheels 218, and four sets of fasteners 220, such as bolts and nuts. The wheels 218 are connected to the main frame 32, by the fasteners 220, each of which pass through an aperture 222 in a side cover 34 and an aperture 224 in the side panel portion 38 of the housing 24, as seen in FIG. 2. The wheel assembly 29 is only connected to the main frame 32 and used when the robotic washing apparatus 20 is used on an sloped surface. When used on sloped or an inclined surface the vacuum assembly 28 and some of the sensing and control systems will not be used as the weight of the robotic washing apparatus 20 will keep it in positive contact with the building surface and it will simply roll over the window frames and seams, if any.

To use the robotic washing apparatus 20 electricity is provided to the operator control pendant 206. When the operator control pendant 206 is activated in the preferred embodiment, it is forced into a manual mode regardless of the switch 210 state. To enter automatic mode, the Auto/Manual switch 210 must first be switched to "Manual" and then back to "Auto." Similarly, the operator control pendant 206 is forced into a "motor off" state when activated. These two precautions prevent runaway when powering up or during a electrical power interruption.

Figure 19:
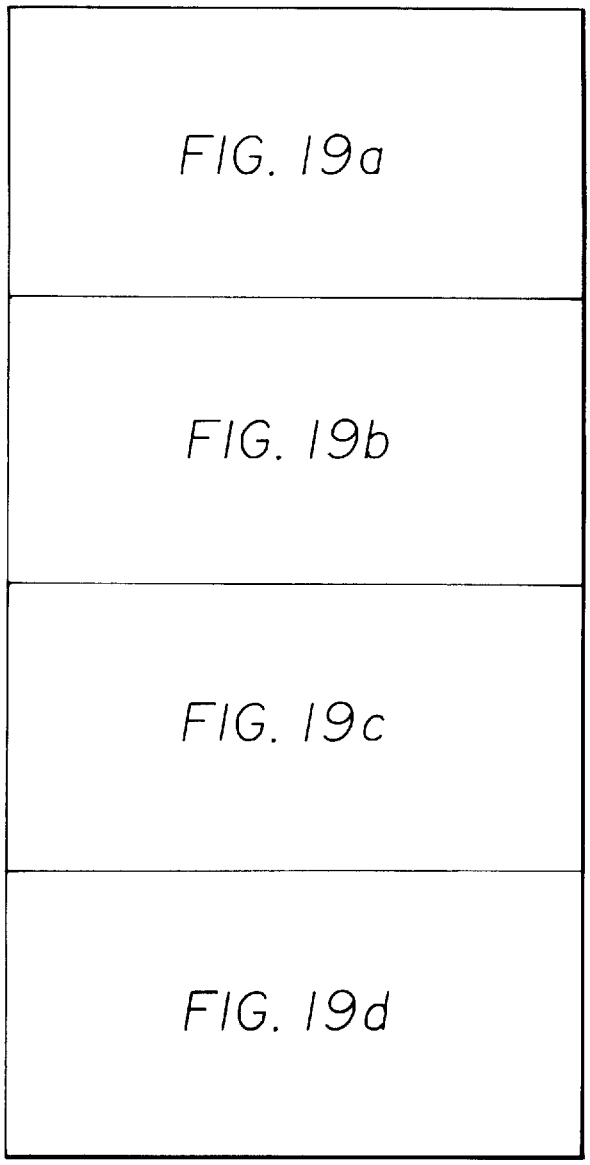
FIG. 19 is a flow chart of the steps performed via the software located in the robotic washing apparatus.
Figure 19A:
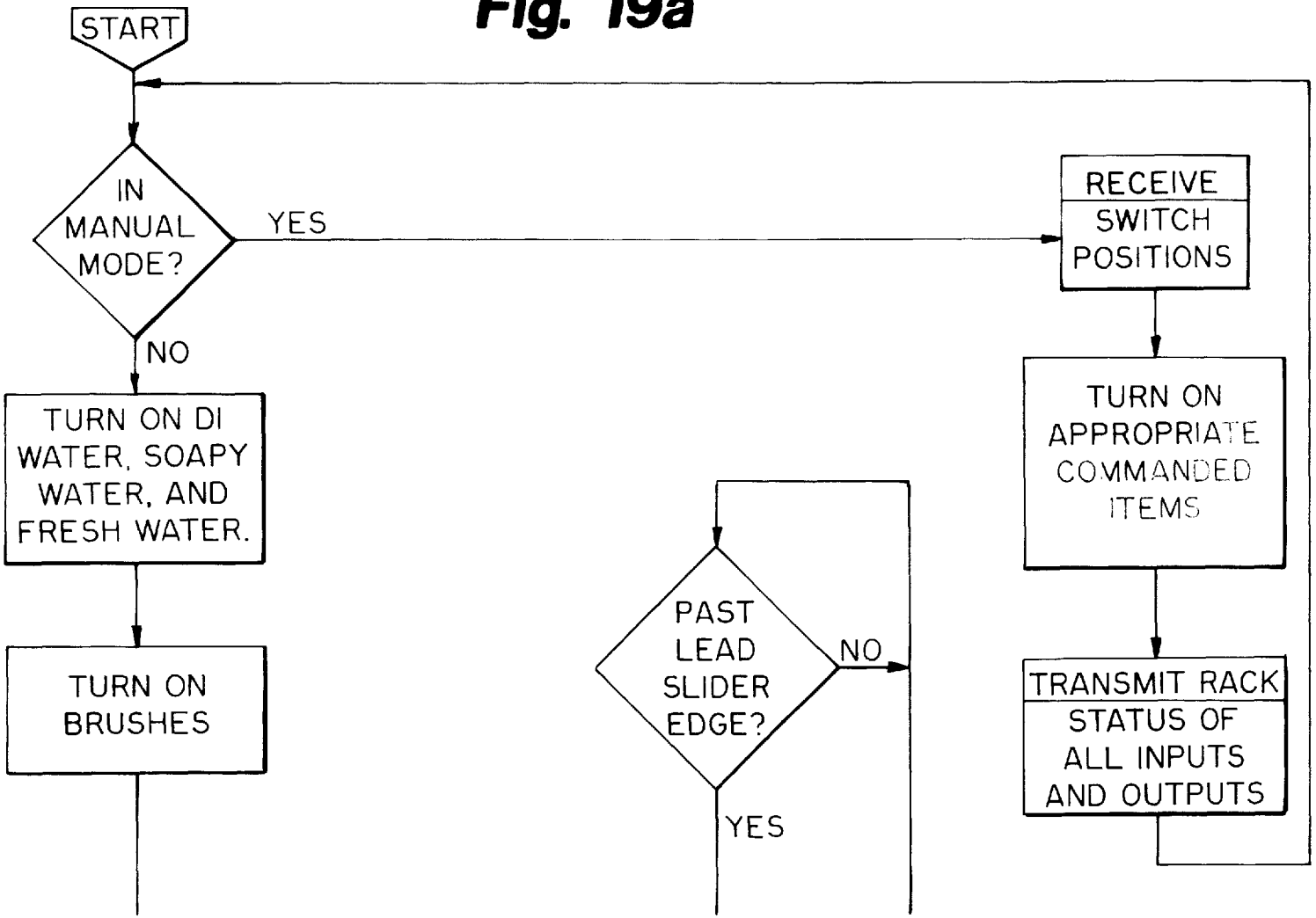
Figure 19B:
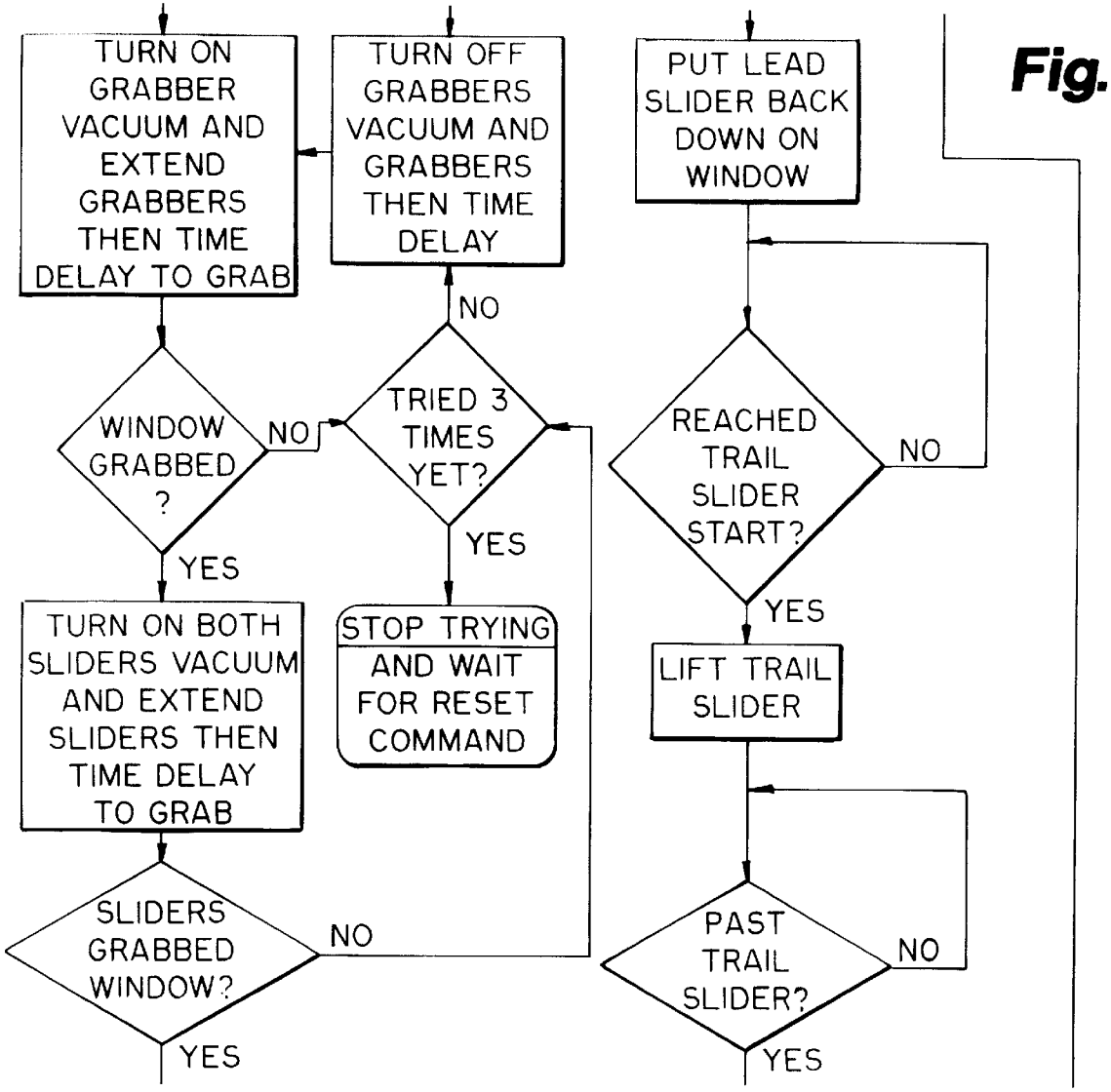
Figure 19C:
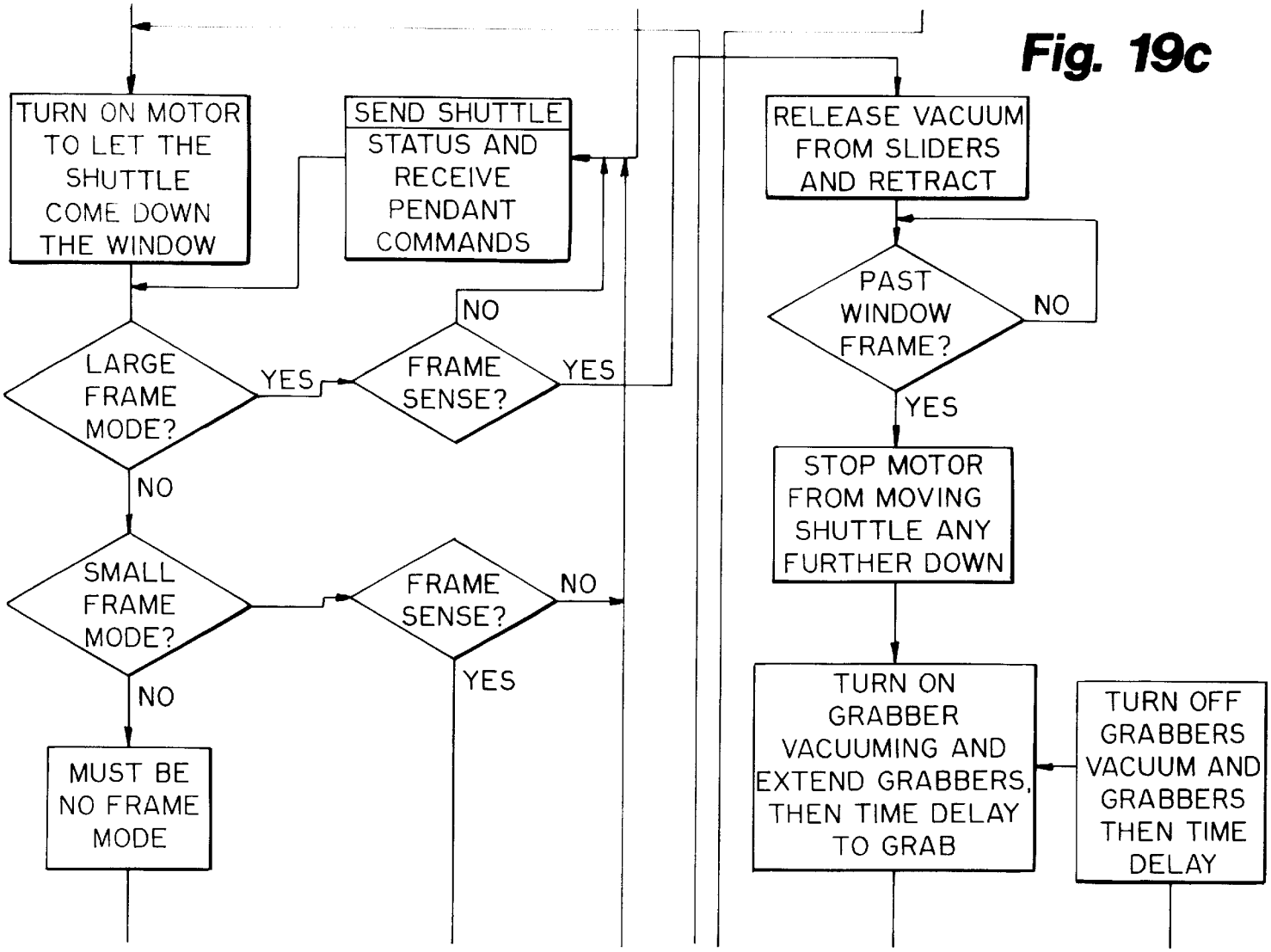
Figure 19D:
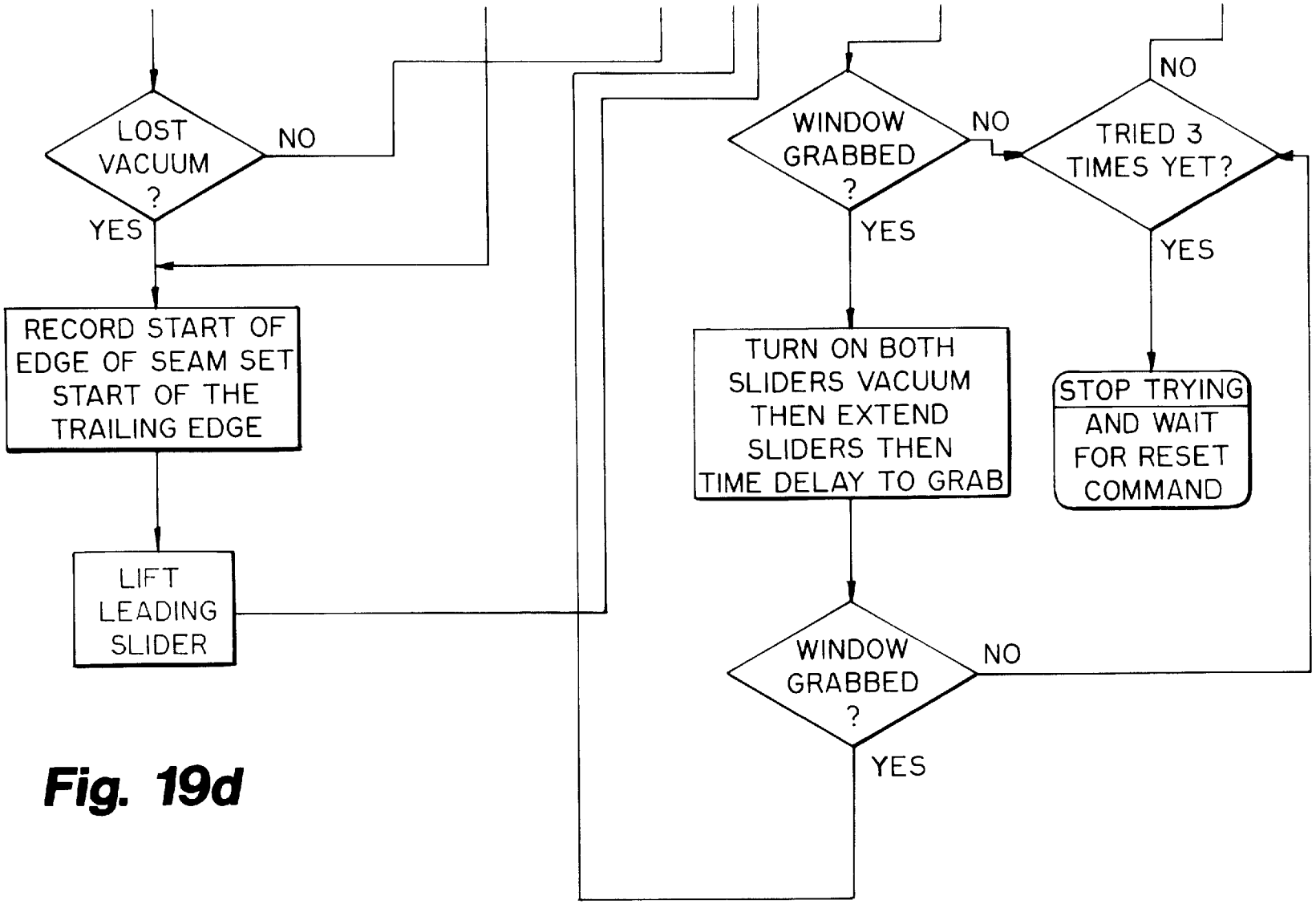

The operator control pendant 206 has two basic modes of operation: Manual mode and Automatic mode. Manual mode is entered by placing the Auto/Manual switch 210 in manual mode and then toggling the Reset/Run switch 210 from Reset to Run. In Manual mode, the operator has complete control over the washer, as shown in FIG. 19. The only commands that cannot be carried out are ones that would drive the robotic washing apparatus 20 past the top chain marker reflector and bottom chain marker reflector 188, 190, respectively, continue to drive the robotic washing apparatus 20 after a drive motor 50 current overload, or switch the drive motor 50 direction while the drive motor 50 is turned on. If an end-of-chain or over-current condition does occur by driving the robotic washing apparatus 20 past one of the chain marker reflectors, 188, 190, it can only be cleared by turning off the drive motor 50, switching the motor direction, and then turning the drive motor 50 back on again to drive the robotic washing apparatus for a short distance in the opposite direction.

To initiate the automatic cleaning sequence for use when cleaning a vertical or nearly vertical surface, the robotic washing apparatus 20 must be positioned over a window or other surface at the top of the building. The frame selector switch 210 must be set to "Tall," "Short" or "None." Then the Auto/Manual switch 210 is toggled to the "Auto" position and the "Run/Reset" switch is placed in Run. As illustrated in FIG. 9 and the flowchart for the software in the robotic washing apparatus 20 shown in FIG. 19, when activated the robotic washing apparatus 20 will pull itself in contact with the window using the grabber vacuum cups 82 to acquire a grip on the window and pull the robotic washing apparatus 20 to the window. To acquire the window the grabber cylinders 84 are extended to the window and a vacuum grip created by the grabber vacuum cups 82. The grabber cylinders 84 are then retracted pulling the robotic washing apparatus 20 against the window. Next, the slider cylinders 96 are activated moving the slidercucups 86 into contact with the window and a vacuum is created within the slider vacuum cups 86. The vacuum sensors 76 are used to determine if vacuum contact with the window has been achieved by the slider vacuum cups 86. Upon determining that a good vacuum has been achieved, the grabber cups 82 are released and the grabber cylinders 84 further retracted. All the brushes 114, 115 and 116 and sprayers 118, 120 and 122 are then activated, and the robotic washing apparatus 20 will proceed down the building. The water and/or soap solution provides lubrication for the slider vacuum cups 86 so that the slider vacuum cups 86 can maintain their vacuum connection while sliding across smooth and relatively smooth surfaces such as glass, marble, metal and the like.

Two sets of slider vacuum cups 86 are used in the present invention to maintain positive contact with the window when cleaning over a window frame or because certain gaps between windows may cause vacuum to be lost. When a frame or gap is detected, the leading slider assembly 105 is lifted while the trailing slider assembly 106 maintains contact. Once the leading slider assembly 105 is clear of the frame or gap, it is lowered again and vacuum reapplied. At this point, the trailing slider assembly 106 can be "lifted" to clear the upcoming frame or gap and lowered again once it is clear of the frame. This allows uninterrupted cleaning of the window and the frames.

If either of the vacuum slider cups 86 do not re-acquire the window after "stepping over" the window frame, the robotic washing apparatus 20 will stop and the grabber vacuum cup assemblies 66 will re-acquire the window thereby ensuring both of the slider vacuum cup assemblies 68 to make positive contact with the window and create a vacuum connection.

If the robotic washing apparatus 20 is not in the process of "stepping over" a window frame or seal, and the vacuum sensor 76 for the trailing slider assembly 106 detects a loss of vacuum, the robotic washing apparatus 20 will stop, the slider vacuum cups assembly 68 will retract and the grabber vacuum cup assemblies 66 will begin the process of pulling itself in contact with the window, as seen in FIG. 9. Once positive contact is again achieved, the cleaning process automatically resumes. If, after reacquiring the window, the vacuum sensor 76 does not detect vacuum, the robotic washing apparatus 20 will try to grab the building again. In the preferred embodiment, the robotic washing apparatus 20 will try three times, then stop.

Figure 4:
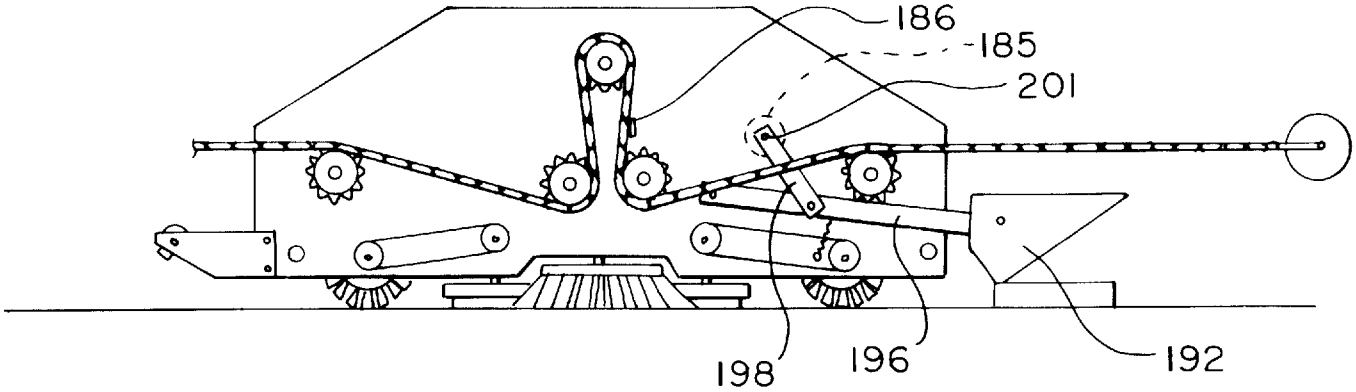
FIG. 4 is a side view of a robotic washing apparatus incorporating the improvements of the present invention with the side housing cover removed and showing the window frame sense foot positioned on a window frame.
Figure 4C:
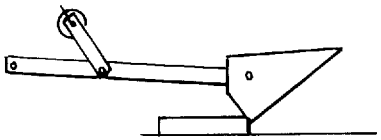
FIG. 4*c* is a side view of a window frame sense assembly of a robotic washing apparatus incorporating the improvements of the present invention showing it making contact with the trailing edge of a window frame.
Figure 4B:
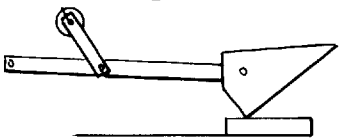
FIG. 4*b* is a side view of a window frame sense assembly of a robotic washing apparatus incorporating the improvements of the present invention showing it supported by the maximum height of a window frame.
Figure 4A:
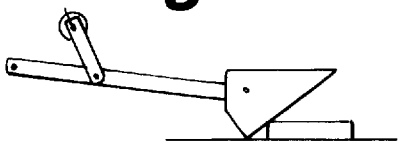
FIG. 4*a* is a side view of a window frame sense assembly of a robotic washing apparatus incorporating the improvements of the present invention showing it making contact with the leading edge of a window frame.

The robotic washing apparatus 20 detects window frames or other obstacles with its window frame sense assembly 180. As the robotic washing apparatus 20 approaches a raised window frame, the sensor feet 192 contact the window frame edge and ride up and over the frame as seen in FIGS. 10 and 11. As seen in FIGS. 4*a–c*, movement of the sensor feet 192 causes the fulcrum lever 198 to move the potentiometer 185, thereby recording the profile of the frame. This information and the information provided by the encoder 51 is used by the onboard computer 184 to cause the slider vacuum cups assemblies 68 to "step over" most frames.

When the robotic washing apparatus 20 reaches the bottom of the surface to be cleaned the bottom chain marker 190 is sensed by the photo reflective sensor 186, vacuum to the slider vacuum cups assemblies 68, the brushes 114, 115 and 116, tap water and soapy water supplies are turned off. The de-ionized rinse will continue spraying for a few seconds to remove any residual cleanser. Finally, the operator will then switch the operator control pendant 206 to manual and the operator can relocate the carriage 22 to position the robotic washing apparatus in line with the next vertical surface to be cleaned and activate the robotic washing apparatus 20 to drive up the chains 48 without the vacuum cup assemblies 66, 68 being engaged. The robotic washing apparatus 20 is now in position to repeat its cleaning cycle.

The process of stepping over the window frames or gaps depends on the state of the selector switch:

No Frames

Figure 10A:
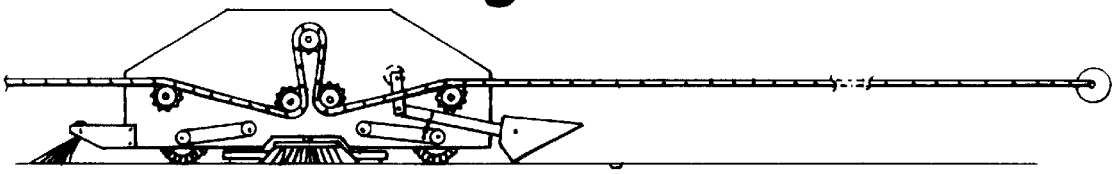
FIGS. 10*a–f* is a sequence depicting the robotic washing apparatus in side view traversing a window seam.
Figure 10B:
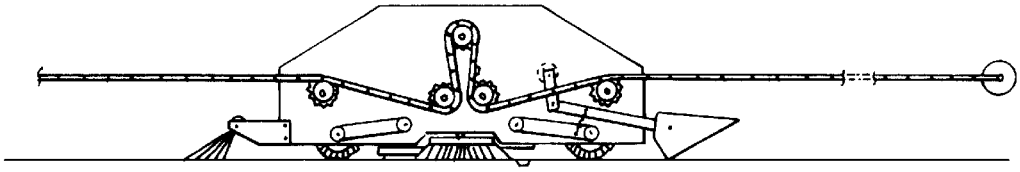
Figure 10C:
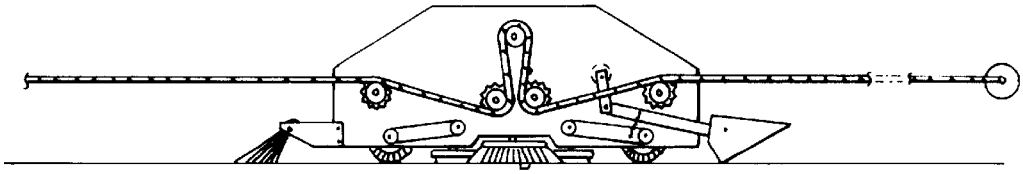
Figure 10D:
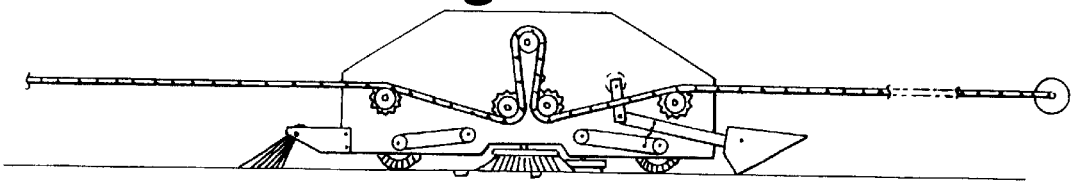
Figure 10E:
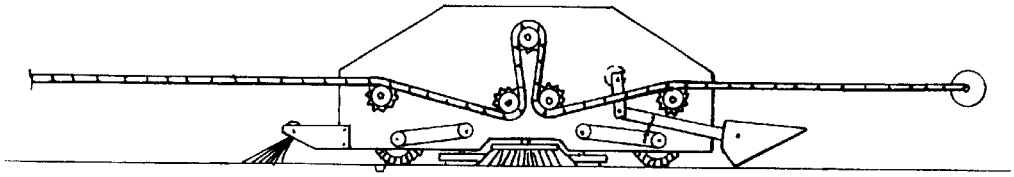
Figure 10F:
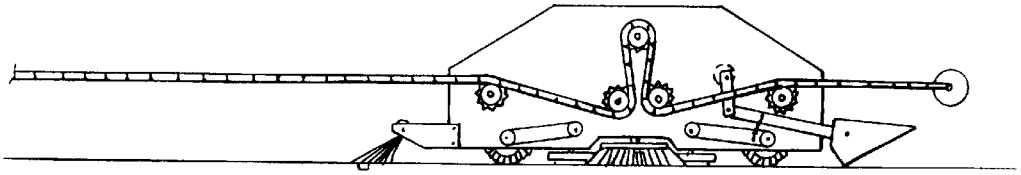
Figure 11A:
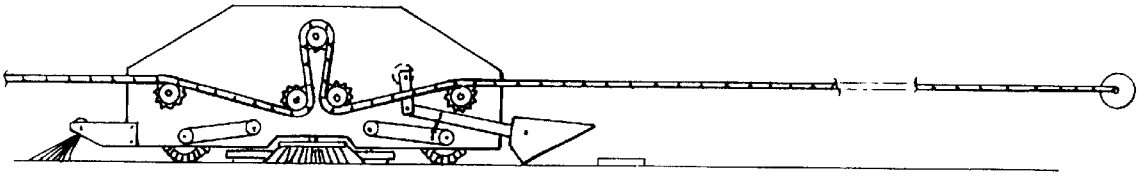
FIGS. 11*a–i* is a sequence depicting the robotic washing apparatus in side view traversing a small window frame.
Figure 11B:
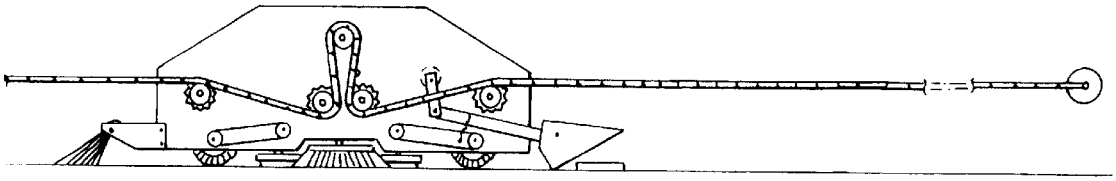
Figure 11C:
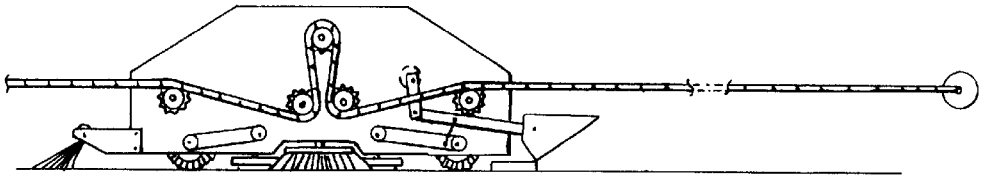
Figure 11D:
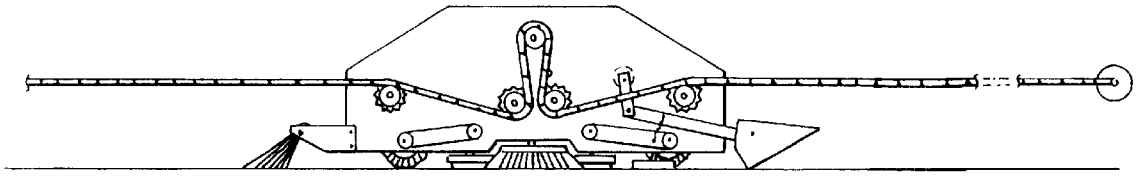
Figure 11E:
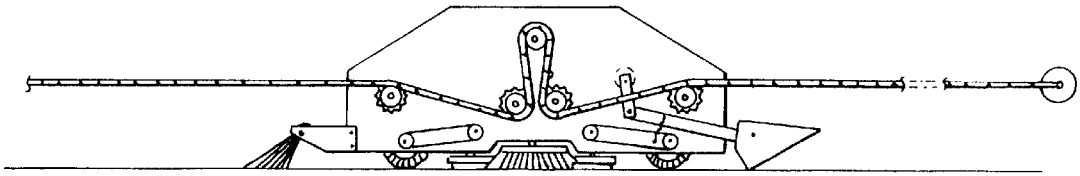
Figure 11F:
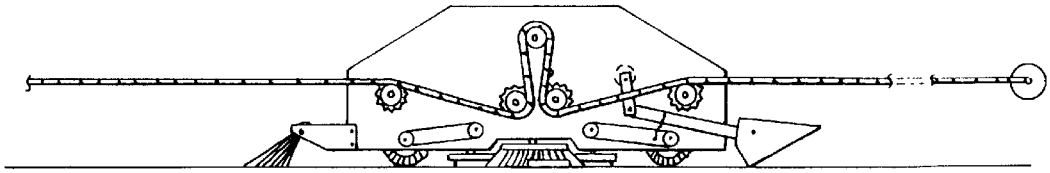
Figure 11G:
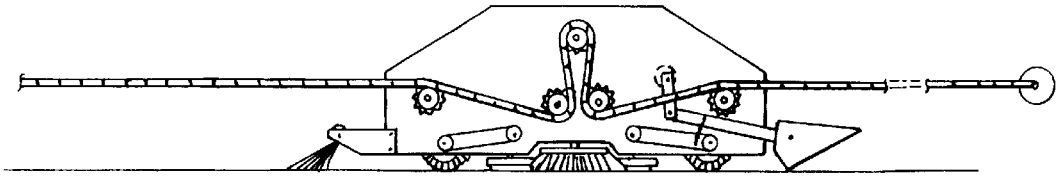
Figure 11H:
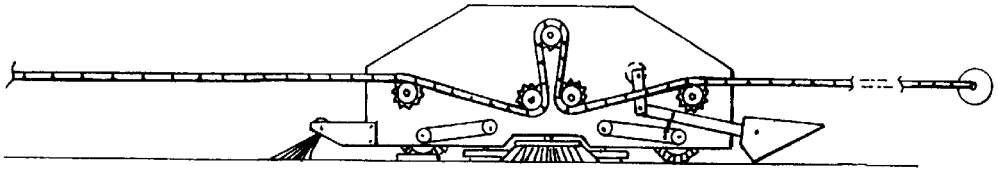
Figure 11I:
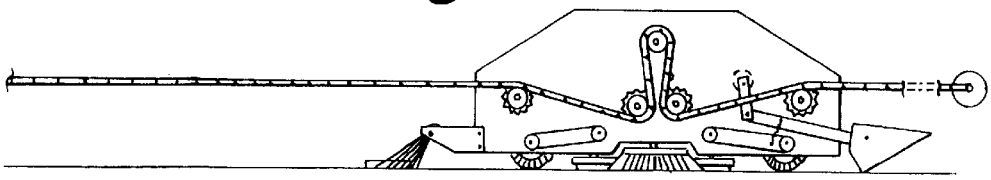
Figure 12A:
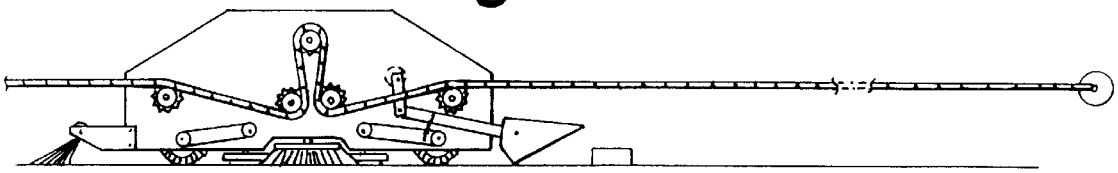
FIGS. 12*a–g* is a sequence depicting the robotic washing apparatus in side view traversing a large window frame.
Figure 12B:
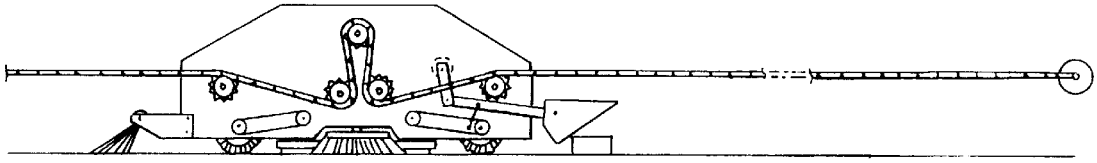
Figure 12C:
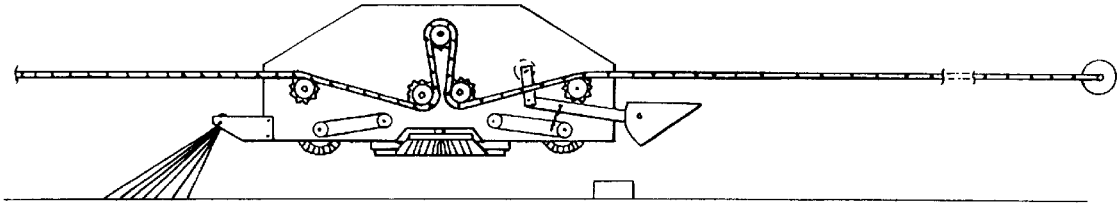
Figure 12D:
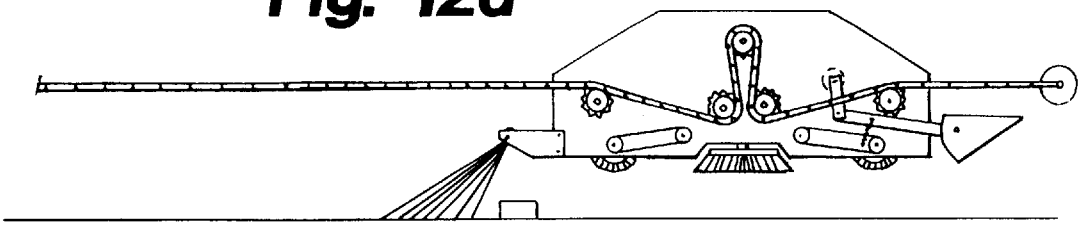
Figure 12E:
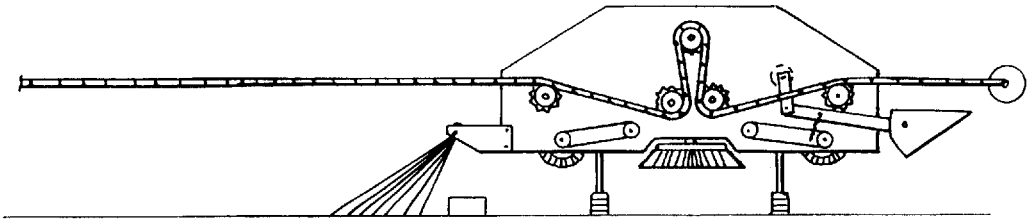
Figure 12F:
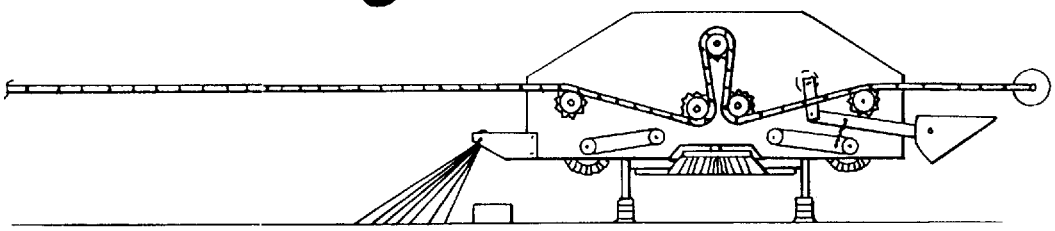
Figure 12G:
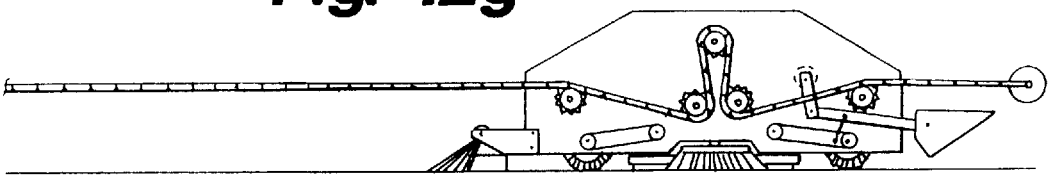

On a building with no frames, the gaps or seals between the window panes is sensed by loss of vacuum on the leading slider assembly 105. As seen in FIG. 10*b*, the leading slider assembly 105 will then lift immediately and lower again after it has cleared the gap. As seen in FIG. 10*d*, the trailing slider vacuum assembly 106 will lift just before it reaches the gap based on information provided by the potentiometer 185 and lowers again after it is clear, as seen in FIG. 10*e*.

Short Frames

As shown in FIG. 11, the robotic washing apparatus 20 can traverse a short frame with at least one slider vacuum assembly 68 attached to the window. As depicted in FIG. 116, the window sense potentiometer 185 detects a frame in the path of the robotic washing apparatus 20. The onboard computer 184 is programmed to wait until the leading slider assembly 105 is immediately adjacent the frame before lifting it as seen in FIG. 11*e* and waits until the leading slider assembly 105 has just cleared the frame before lowering it again as seen in FIG. 11*f*. As seen in FIGS. 11*g* and 11*h*, this process is repeated for the trailing slider assembly 106.

Tall Frames

If the window frames are too tall to be "stepped over", the robotic washing device 20 must release the window, travel across the frame, and reacquire the window as depicted in FIG. 12. Upon detecting a certain height via the potentiometer 185, both slider vacuum cups assemblies 68 release the window and the robotic washing apparatus 20 will swing away from the building. As depicted in FIGS. 12*e*–12*g*, after the robotic washing apparatus 20 has traversed the frame, it will stop, re-acquire the window, and then proceed to clean the next window pane.

In an alternative embodiment using the grabber/slider vacuum cup assemblies 310, the robotic washing apparatus 20 performs the same operations, but all the independent functions of the grabber vacuum cup assemblies 66 and slider vacuum cups assemblies 68 are performed by the grabber/slider vacuum cup assemblies 310. Whether the robotic washing apparatus is acquiring the cleaning surface for the first time or "stepping over" an obstacle, the cylinders 316 extend out driving the base 312 toward the surface to be cleaned. The air shafts 318 slide through the collars 322 until the vacuum cups 314 make contact with the surface to be cleaned. A vacuum connection is the established to the surface to be cleaned. This position is depicted in FIG. 14*b* and is referred to as the grabber position. Once contact is made the cylinders 316 retract to their cleaning positions, which is that position that positions the brushes 114, 115 and 116 in sufficient contact with the cleaning surface. This position is depicted in FIG. 14*c* and is referred to as the slider position. All the brushes 114, 115 and 116, and sprayers 118, 120 and 122 are then activated, and the robotic apparatus 20 will proceed down the building.

Figure 14A:
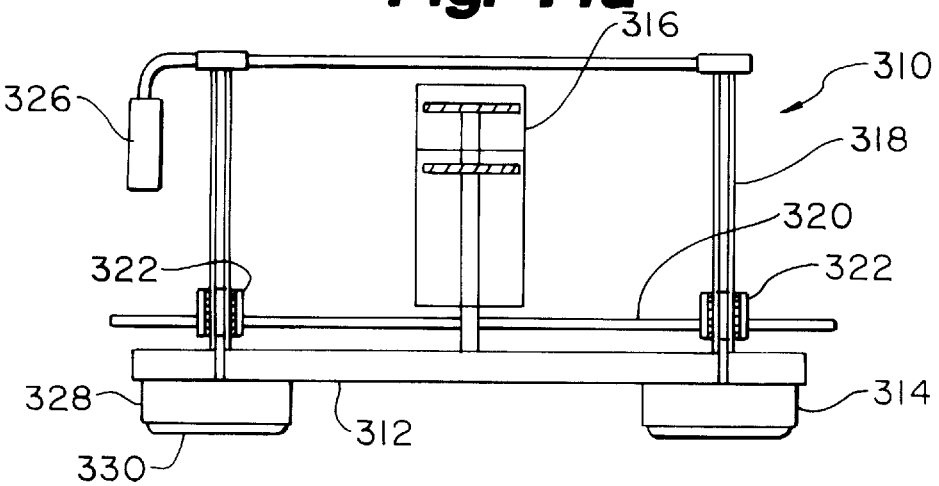
FIG. 14*a–c* are partially sectional plan views of an alternative suction cup assembly that can be used in the robotic washing apparatus wherein one set of vacuum cups functions as both the slider cups and plunger cups.
Figure 14B:
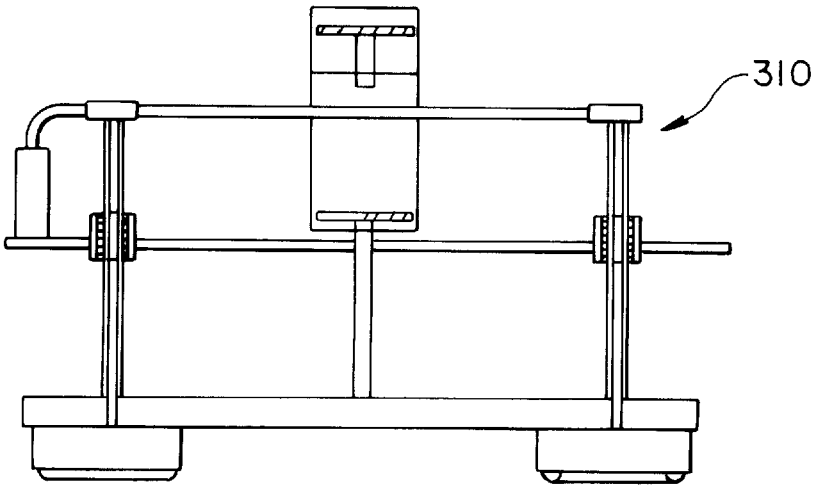
Figure 14C:
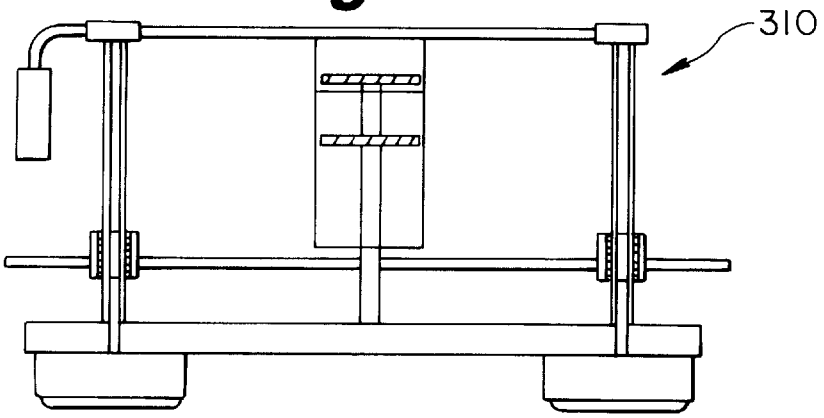
Figure 15:
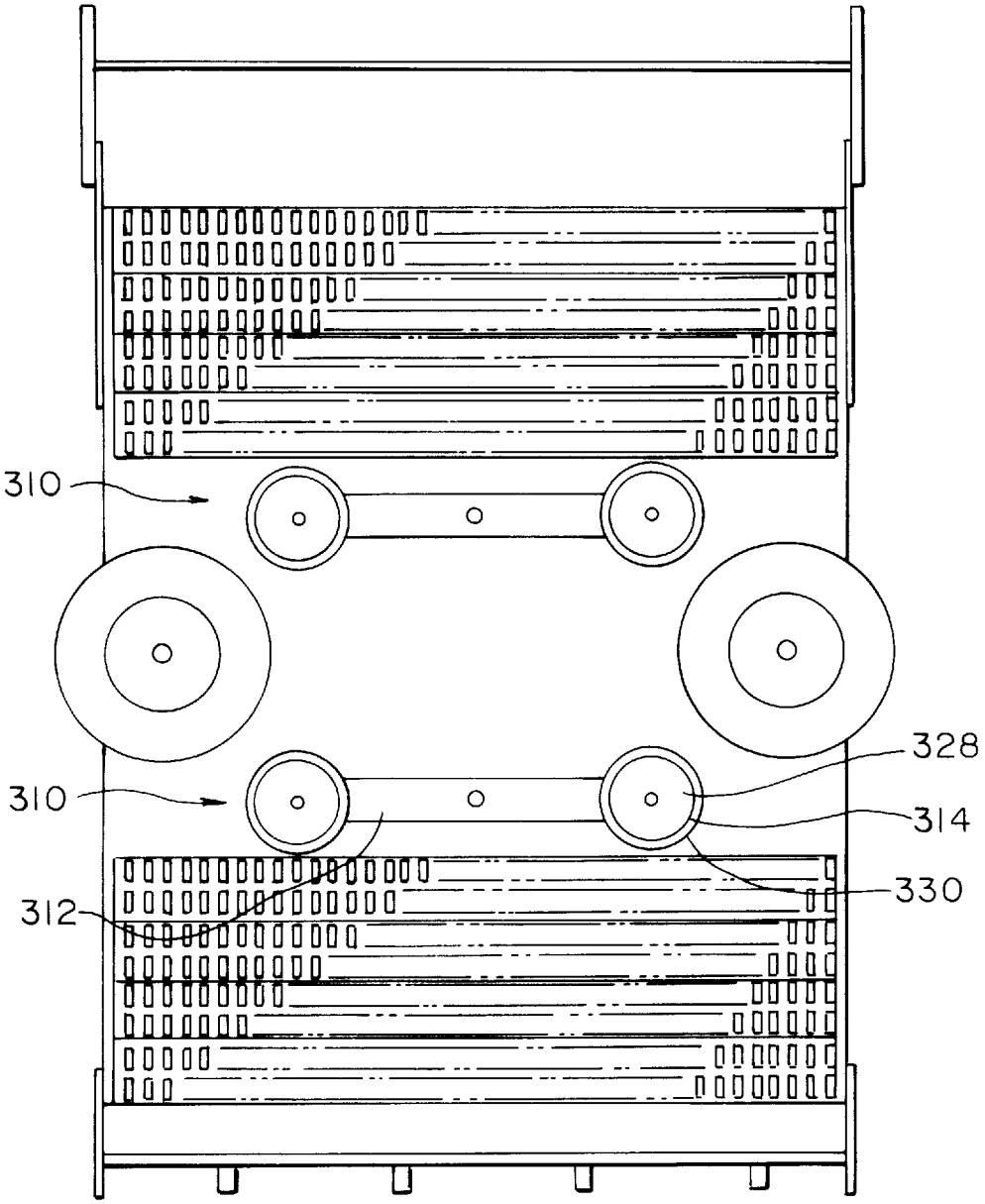
FIG. 15 is a bottom plan view of an alternative robotic washing apparatus incorporating the combined slider and plunger cups assembly depicted in FIGS. 14*a–c*.

When the grabber/slider vacuum cup assemblies 310 are not in use they are fully retracted as depicted in FIG. 14*a* and their position is referred to as the travel position. In the travel position the robotic washing apparatus 20 can be driven up or down the chains 48 without the vacuum cup assemblies 310 being engaged. The assemblies 310 are sufficiently recessed so that the brushes 114, 115 and 116 will make contact with the surface being cleaned and not the assemblies 310 if the wind or other forces cause the robotic washing apparatus 20 to contact the surface.

In the preferred embodiment the chains 48 consist of acetyl plastic rollers on stainless steel pins connected to stainless steel links. The plastic rollers protrude beyond the stainless steel components preventing damage to the windows or the building.

Although a description of the preferred embodiment has been presented, it is contemplated that various changes, including those mentioned above, could be made without deviating from the spirit of the present invention. For example, the present invention could be modified and used for painting various vertical, nearly vertical or sloped surfaces. When used for painting a modified robotic washing apparatus could spray paint on the surface of the structure, while the apparatus is powered up the structure. It is contemplated that brushes would not be used when using a modified robotic washing apparatus for painting, and that the sliding vacuum assembly may or may not be used. If the vacuum assembly is to be used the paint would need to be dispensed from a spray bar positioned along the lowest edge of the housing frame. If the vacuum assembly is not used, the modified robotic washing apparatus will be positioned by the carriage at a distance from the structure so as to optimize the spray coverage.

It should also be understood that the robotic washing apparatus could be used to simply spray fluids on the surface of a structure to clean it, and/or to apply a prewash application of cleaning fluid. Because the brushes are not used to scrub the surface of the structure, the robotic washing apparatus would not need to be in contact with the structure surface.

We claim:

1. An apparatus for applying fluids to the exterior surfaces of vertical or nearly vertical structures, the apparatus being suspended adjacent a building surface by a relocatable carriage, the apparatus comprising:

a housing;

multiple spray nozzles mounted on said housing for spraying the fluids;

a drive assembly attached to said housing, said drive assembly including two drive chains each having a top end and a bottom end, a drive motor, and a sprocket assembly;

a restraining member, said restraining member attached to said bottom ends of said drive chains; and at least two grabber/slider vacuum cup assemblies, each said grabber/slider vacuum cup assembly including at least one vacuum cup and at least one pneumatic cylinder being extendable and retractable, said grabber/slider vacuum cup assemblies being extendable for making contact with the building surface and retractable for pulling the apparatus toward the building surface, further each said at least one vacuum cup including a deformable annular suction pad for maintaining slidable contact with the building surface when applying fluids to the exterior surfaces.

2. The apparatus of claim 1, wherein said restraining member is a weight.

3. An apparatus for applying fluids to the exterior surfaces of vertical or nearly structures that is able to traverse obstacles on the side of buildings, comprising:

a housing;

a drive assembly attached to said housing;

a sensor assembly for sensing obstacles on, and gaps in, the building surface, said sensor assembly including two sensor feet, a spacing bar, and two main levers, one end of each said main lever movably connected to one side of said housing, one said sensor foot being fixedly attached to the other end of each said main lever, and said spacing bar being disposed between and fixedly attached to said sensor feet;

at least two vacuum suction cup assemblies connected to said housing, each said vacuum suction cup assembly having at least one slidable suction cup; and at least one set of spray nozzles mounted on said housing.

4. The apparatus of claim 3, further comprising at least one cylindrical brush rotatably mounted on said housing.

5. The apparatus of claim 3, further comprising a second set of spray nozzles mounted on said housing, wherein said at least one set of spray nozzles is part of a cleaning fluid system, and said second set of spray nozzles is part of a rinse water system.

6. The apparatus of claim 5, further comprising a third set of spray nozzles mounted on said housing, said third set of spray nozzles being part of a deionized water system.

7. The apparatus of claim 3, wherein said drive assembly includes two drive chains, a drive motor, an encoder and at least one sprocket assembly.

8. The apparatus of claim 7, wherein said housing has a main frame, said main frame having two side panel portions, a front plate portion, a rear plate portion and a floor plate portion.

9. The apparatus of claim 8, wherein said at least one sprocket assembly includes a drive sprocket and at least two idler sprockets mounted on each said side panel portions.

10. The apparatus of claim 9, wherein each said at least two vacuum suction cup assemblies is extendable and retractable and include at least one pneumatic cylinder.

11. The apparatus of claim 10, wherein each said slidable suction cup is faced with a low-friction ring.

12. The apparatus of claim 3, wherein said sensor assembly further includes a fulcrum lever and a potentiometer, one end of said fulcrum lever is connected to one said main lever and the other end of said fulcrum lever is connected to said potentiometer.

13. The apparatus of claim 3, further comprising a computer mounted on said main frame, said computer being operably connected to said potentiometer, said encoder and said vacuum suction cup assemblies whereby the information provided by said potentiometer and said encoder is used by the computer to cause said at least two vacuum suction cup assemblies to independently extend and retract as the apparatus traverses an obstacle or gap.

14. A robotic washing apparatus for cleaning vertical or nearly vertical building surfaces, comprising:

a housing having a main frame, said main frame having two side panel portions, a front plate portion, a rear plate portion, and a floor plate portion;

a drive assembly including two drive chains, a drive motor, an encoder, and at least one sprocket assembly, said at least one sprocket assembly including a drive sprocket and at least two idler sprockets mounted on each said side panel portions, one of said drive chains being connected to each said drive sprocket;

a sensor assembly for sensing obstacles on, and gaps in, building surfaces, said sensor assembly including a two sensor feet, a spacing bar, and two main levers, one end of each said main lever movably connected to one of said side panel portions, one said sensor foot being fixedly attached the other end of each said main lever, and said spacing bar being disposed between and fixedly attached to said sensor feet, said sensor assembly further including a fulcrum lever and a potentiometer, one end of said fulcrum lever being connected to one said main lever and the other end of said fulcrum lever being connected to said potentiometer;

at least two slidable vacuum cup assemblies operably connected to said main frame;

a computer mounted on said main frame, said computer being operably connected to said potentiometer, said encoder and said vacuum suction cup assemblies whereby the information provided by said potentiometer and said encoder is used by the computer to cause said at least two vacuum suction cup assemblies to independently extend and retract as the apparatus traverses an obstacle or gap so that at least one vacuum suction cup assembly is in contact with the surface of the structure at all times while the apparatus traverses the obstacle or gap.

15. The robotic washing apparatus of claim 14, further comprising at least one extendable grabber vacuum cup assembly.

16. The robotic washing apparatus of claim 14, further comprising at least two sets of spray nozzles mounted on said housing wherein one of said at least two sets of spray nozzles is part of a cleaning fluid system, and the second of said at least two sets of spray nozzles is part of a rinse water system.

17. The robotic washing apparatus of claim 16, further comprising a third set of spray nozzles mounted on said housing, said third set of spray nozzles being part of a deionized water system.

18. The robotic washing apparatus of claim 14, wherein each said at least two vacuum suction cup assemblies is extendable and retractable and includes at least one pneumatic cylinder.

19. An apparatus for applying fluids to the exterior surfaces of vertical or nearly vertical structures, the apparatus being suspended adjacent a building surface by a relocatable carriage, the apparatus comprising:

a housing including a main frame;

at least one spray nozzle connected to said housing;

a drive assembly attached to said housing, said drive assembly including two drive chains each having a top end and a bottom end, a drive motor, and a sprocket assembly;

a sensor assembly for sensing obstacles on, and gaps in, the building surface, said sensor assembly connected to said housing;

at least two slidable vacuum cup assemblies operably connected to said main frame; and a computer mounted on said main frame, said computer being operably connected to said sensor assembly and said vacuum suction cup assemblies whereby the information provided by said sensor assembly is used by the computer to cause said at least two vacuum suction cup assemblies to independently extend and retract as the apparatus traverses an obstacle or gap so that at least one vacuum suction cup assembly is in contact with the surface of the structure at all times while the apparatus traverses the obstacle or gap.

* * * * *

UNITED STATES PATENT AND TRADEMARK OFFICE

CERTIFICATE OF CORRECTION

PATENT NO. : 5,890,250

DATED : April 6, 1999

INVENTOR(S) : Michael R. Lange and Jeff Kerr

It is certified that error appears in the above-indentified patent and that said Letters Patent is hereby corrected as shown below:

On the title page, item

[73] Assignee: "Sky Robitics, Inc." should be --[73] Assignee: Sky Robotics, Inc.--

Signed and Sealed this

Thirty-first Day of August, 1999

*Attest:*

Q. TODD DICKINSON

*Attesting Officer*

*Acting Commissioner of Patents and Trademarks*